US009120983B2

(12) United States Patent
Wickes et al.

(10) Patent No.: US 9,120,983 B2
(45) Date of Patent: Sep. 1, 2015

(54) PROCESS AND SYSTEM FOR ENHANCED SEPARATION OF HYDROCARBON EMULSIONS

(75) Inventors: Russell H Wickes, Calgary (CA); Mike Wasylyk, Calgary (CA); Bailey R Gould, Calgary (CA)

(73) Assignee: Cenovus Energy Inc., Calgary (CA)

( * ) Notice: Subject to any disclaimer, the term of this patent is extended or adjusted under 35 U.S.C. 154(b) by 206 days.

(21) Appl. No.: 13/560,920

(22) Filed: Jul. 27, 2012

(65) Prior Publication Data

US 2013/0140216 A1 Jun. 6, 2013

Related U.S. Application Data

(60) Provisional application No. 61/513,468, filed on Jul. 29, 2011.

(51) Int. Cl.

| | |
|---|---|
| ***C10G 33/04*** | (2006.01) |
| ***C10C 3/08*** | (2006.01) |
| ***C10G 33/08*** | (2006.01) |

(52) U.S. Cl.
CPC .. *C10G 33/04* (2013.01); *C10C 3/08* (2013.01)

(58) Field of Classification Search
CPC ..... C10C 3/08; C10G 33/00; C10G 33/04; C10G 33/08
USPC ..... 196/14.52; 208/187, 188; 516/135
See application file for complete search history.

(56) References Cited

U.S. PATENT DOCUMENTS

| | | | |
|---|---|---|---|
| 4,126,182 | A | 11/1978 | Allen et al. |
| 5,507,958 | A | 4/1996 | White-Stevens |
| 2007/0267325 | A1 | 11/2007 | Vu |

FOREIGN PATENT DOCUMENTS

| | | |
|---|---|---|
| CA | 2531335 | 1/2005 |
| CA | 2550118 | 6/2005 |
| WO | WO 9219351 | 11/1992 |

OTHER PUBLICATIONS

Sunil Kokal, SPE Distinguished Lecturer Series, "Crude Oil Emulsions: Everything You Wanted to Know but Were Afraid to Ask" from web link www.spe.org/dl/docs/2008/Kokal.pdf.
Kokal, S. L., Crude Oil Emulsions (Chapter 12), Petroleum Engineering Handbook, Society of Petroleum Engineers (SPE): Richardson, TX, 2006; vol. 1, issue 12, pp. 533-570.
Webpage printout: Biodiesel & SVO Discussion Forums, "Breaking Emulsions with Salt Water", 2009.

*Primary Examiner* — Walter D Griffin
*Assistant Examiner* — Derek Mueller
(74) *Attorney, Agent, or Firm* — Knobbe Martens Olson & Bear LLP

(57) ABSTRACT

The invention relates to treating a hydrocarbon-comprising emulsion with an aqueous component to form an aqueous component-treated emulsion, and processing the treated emulsion to recover the hydrocarbon. The aqueous component is contacted with the hydrocarbon-comprising emulsion in a manner and proportion so as to promote coalescence of the like phases while minimizing shear, which results in a decreased viscosity of the emulsion and a shift away from the emulsion inversion region toward a water-continuous state.

33 Claims, 31 Drawing Sheets

Normal Heat Exchanger Pressure Drop = about 100 kPad

Upset Heat Exchanger Pressure Drop = about 300 kPad

Poor Separation in FWKO

Larger Unresolved Emulsion Layer

Good Separation in FWKO

Smaller Unresolved Emulsion Layer

| Tag | Description | Min | Max | Current |
|---|---|---|---|---|
| A03_PCI_315 | P-0304B Min Flow Recycle | 0 | 64.49 | 3.1 |
| A03_PCI_335 | E-0314F 1/F2 INOUT DEF PRESS | 80 | 350 | 108 |
| A03_AI_3351 | V0301B % Water in Emulsion to FWKO | 0 | 100 | 75.6 |
| A03_AI_3303 | V0302C % Water in Emulsion to Treater | 0 | 100 | 33.6 |

PROCESS AND SYSTEM FOR ENHANCED SEPARATION OF HYDROCARBON EMULSIONS

CROSS-REFERENCE TO RELATED APPLICATION

This application claims the benefit of Provisional Application No. 61/513,468, filed Jul. 29, 2011, the entire content of which is incorporated herein.

FIELD OF THE INVENTION

The present invention relates generally to hydrocarbon recovery, and particularly to improving hydrocarbon recovery by enhancing separation of hydrocarbon-comprising emulsions.

BACKGROUND OF THE INVENTION

Hydrocarbon resources present significant technical and economic recovery challenges due to formation of emulsions during recovery and processing. The resultant emulsions may be, for example, oil-in-water, water-in-oil phase configurations or a combination thereof. The emulsions can be complex, and may include solids (e.g., fines), organic and inorganic species, and emulsion stabilizing species. Also, to the extent that gases may be among the produced hydrocarbons, some emulsions may also include a gas phase.

To maximize oil production and to also maximize the volume of clean water which may be either disposed of or recycled, it is important to effectively separate or "break" the emulsions. A number of approaches to breaking emulsions have been recognized within the industry, examples of which include the use of chemicals (e.g., altering surface tension characteristics), thermal techniques (e.g., modulating heat), mechanical techniques (e.g., modulating residence time), and electrical techniques (e.g., providing electrostatic grids).

Although the present approaches facilitate some degree of resolution of the emulsions, there continues to be a need for more effective and economically feasible emulsion breaking techniques to improve the economical performance of hydrocarbon recovery, improve process robustness and stability, and provide an economical method of debottlenecking existing facilities.

SUMMARY OF THE INVENTION

The present invention according to an embodiment provides a process for enhanced separation of a hydrocarbon-comprising emulsion. The system involves contacting the hydrocarbon-comprising emulsion with an aqueous component at a first selected location in a hydrocarbon processing circuit to control an occurrence of a high viscosity event in the hydrocarbon-comprising emulsion. The process further involves dispersing the aqueous component within the hydrocarbon-comprising emulsion under low shear conditions so as to destabilize the hydrocarbon-comprising emulsion and initiate coalescence of like phases to form an aqueous component-treated emulsion, wherein the aqueous component-treated emulsion has an increased water cut and a reduced viscosity as compared to a water cut and a viscosity of the hydrocarbon-comprising emulsion, the aqueous component-treated emulsion being sufficiently stable to pass through one or more processing units downstream of the first selected location without passing through the high viscosity event while being sufficiently unstable to break down into hydrocarbon and aqueous constituents at a second selected location in the hydrocarbon processing circuit downstream of the one or more processing units.

The present invention according to another embodiment provides a system for enhanced separation of a hydrocarbon-comprising emulsion. The system includes means for contacting the hydrocarbon-comprising emulsion with an aqueous component at a first selected location in a hydrocarbon processing circuit to control an occurrence of a high viscosity event in the hydrocarbon-comprising emulsion. The system further includes means for dispersing the aqueous component within the hydrocarbon-comprising emulsion under low shear conditions so as to destabilize the hydrocarbon-comprising emulsion and initiate coalescence of like phases to form an aqueous component-treated emulsion, wherein the aqueous component-treated emulsion has an increased water cut and a reduced viscosity as compared to a water cut and a viscosity of the hydrocarbon-comprising emulsion, the aqueous component-treated emulsion being sufficiently stable to pass through one or more processing units downstream of the first selected location without passing through the high viscosity event while being sufficiently unstable to break down into hydrocarbon and aqueous constituents at a second selected location in the hydrocarbon processing circuit downstream of the one or more processing units.

The present invention according to a further embodiment provides a process for enhanced separation of a hydrocarbon-comprising emulsion. The process involves contacting the hydrocarbon-comprising emulsion with an aqueous component upstream of a degasser. The process further includes dispersing the aqueous component within the hydrocarbon-comprising emulsion under low shear conditions so as to destabilize the hydrocarbon-comprising emulsion and initiate coalescence of like phases to form an aqueous component-treated emulsion, wherein the aqueous component-treated emulsion has an increased water cut and a reduced viscosity as compared to a water cut and a viscosity of the hydrocarbon-comprising emulsion, the aqueous component-treated emulsion being sufficiently stable to pass through the degasser without passing through an emulsion inversion region while being sufficiently unstable to break down into hydrocarbon and aqueous constituents during separation downstream of the degasser.

In various embodiments, the hydrocarbon-comprising emulsion may be derived from an in situ thermal process or crude oil operations, and the in situ thermal process may be steam assisted gravity drainage (SAGD), expanding solvent-steam assisted gravity drainage (ES-SAGD), cyclic steam simulation (CSS), steam flooding (SF), solvent assisted-cyclic steam simulation, toe-to-heel-air-injection (THAI), or solvent aided process (SAP).

In various embodiments, the hydrocarbon-comprising emulsion is a chemically complex heterogeneous tight emulsion which may comprise bitumen and asphaltenes. In various embodiments, the chemically complex heterogeneous tight emulsion comprises a water-in-oil-in-water phase configuration, which may comprise highly sheared droplets (e.g., ranging in size from about 1 μM to about 100 μm, about 1 to 50 μm) and entrained gas.

In various embodiments, the water cut of the hydrocarbon-comprising emulsion is generally within the emulsion inversion region of the hydrocarbon-comprising emulsion. In further embodiments, the increased water cut of the aqueous component-treated emulsion is such that a water-continuous phase is substantially the only phase in the aqueous component-treated emulsion.

In various embodiments, the aqueous component comprises water or is water such as for example, fresh water, process derived water or a combination thereof. In various embodiments, the water may have low salinity.

In various embodiments, the contacting of the aqueous component with the hydrocarbon-comprising emulsion may involve adding the aqueous component to the hydrocarbon-comprising emulsion in pipe or in a vessel, and the adding may be effected using a co-current flow, a counter-current flow, a co-current central flow, or a counter-current central flow. In various embodiments, the aqueous component may be a continuous stream or a spray. In various embodiments, in which contacting is performed upstream of a degasser, the contacting is performed generally in an immediate proximity to the degasser.

In various embodiments, dispersing of the aqueous component may involve a use of a low shear mixer. In further embodiments, separation downstream of the degasser may involve separation in a gravity separator such as a free water knock out unit (FWKO). In various embodiments, break down into hydrocarbon and aqueous constituents of the aqueous component-treated emulsion results in a generally distinct hydrocarbon phase and a generally distinct aqueous phase.

In various embodiments, the process further involves adding a processing aid to the aqueous component-treated emulsion such as for example a diluent, a chemical or a combination thereof.

In various embodiments, the process may further involve degassing the aqueous component-treated emulsion in the degasser to form a degassed aqueous component-treated emulsion, and the degassed aqueous component-treated emulsion may be passed through a heat exchanger to produce a cooled degassed aqueous component-treated emulsion. The cooled degassed aqueous component-treated emulsion may be further processed in the gravity separator to result a reduced rag layer as compared to a rag layer produced from separating the hydrocarbon-comprising emulsion. In various embodiments, the reduced rag layer, a remaining aqueous component-treated emulsion, or both the reduced rag layer and the remaining aqueous component-treated emulsion may be further treated in a treater.

In various embodiments, the process for enhanced separation of a hydrocarbon-comprising emulsion may involve contacting the hydrocarbon-comprising emulsion with an aqueous component upstream of a heat exchanger, and dispersing the aqueous component within the hydrocarbon-comprising emulsion under low shear conditions so as to destabilize the hydrocarbon-comprising emulsion and initiate coalescence of like phases to form an aqueous component-treated emulsion, wherein the aqueous component-treated emulsion has an increased water cut and a reduced viscosity as compared to a water cut and a viscosity of the hydrocarbon-comprising emulsion, the aqueous component-treated emulsion being sufficiently stable to pass through the heat exchanger without passing through an emulsion inversion region while being sufficiently unstable to break down into hydrocarbon and aqueous constituents during separation downstream of the heat exchanger.

In yet further embodiments, the process for enhanced separation of a hydrocarbon-comprising emulsion may involve contacting the hydrocarbon-comprising emulsion with an aqueous component upstream of a separator, and dispersing the aqueous component within the hydrocarbon-comprising emulsion under low shear conditions so as to destabilize the hydrocarbon-comprising emulsion and initiate coalescence of like phases to form an aqueous component-treated emulsion, wherein the aqueous component-treated emulsion has an increased water cut and a reduced viscosity as compared to a water cut and a viscosity of the hydrocarbon-comprising emulsion, the aqueous component-treated emulsion being sufficiently stable to pass into the separator without passing through an emulsion inversion region while being sufficiently unstable to break down into hydrocarbon and aqueous constituents during separation in the separator.

BRIEF DESCRIPTION OF THE DRAWINGS

In accompanying drawings which illustrate embodiments of the invention, by way of example only.

DETAILED DESCRIPTION

Reference will now be made in detail to implementations and embodiments of various aspects and variations to the invention, examples of which are illustrated in the accompanying drawings.

Figure 1:
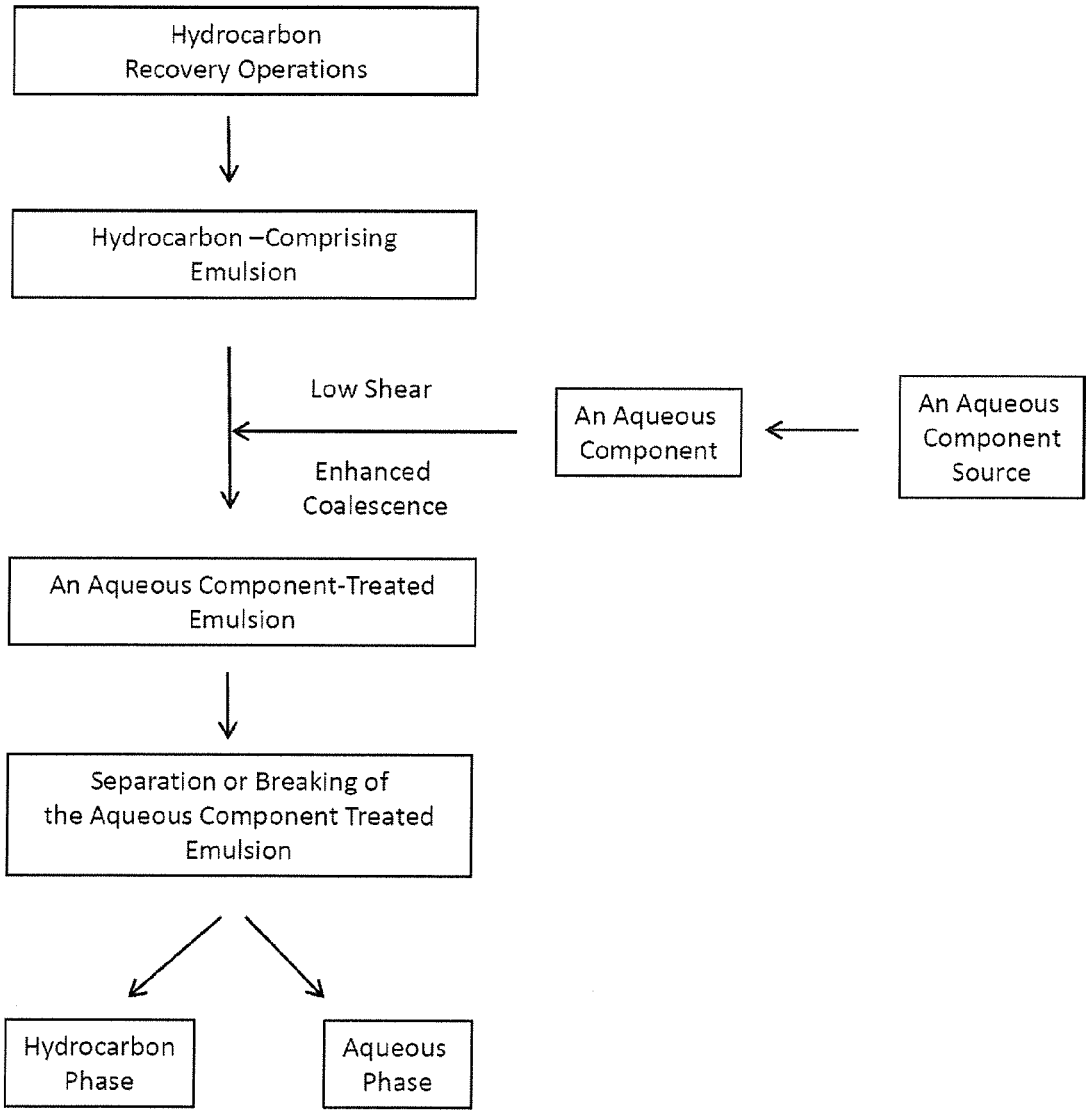
FIG. 1 illustrates a schematic diagram of the process according to the various embodiments.

According to an embodiment as is schematically illustrated in FIG. 1, the process and system of the present invention relate to improving recovery of a hydrocarbon from a hydrocarbon-comprising emulsion by treating the hydrocarbon-comprising emulsion with an aqueous component to form an aqueous component-treated emulsion, and subsequently processing the aqueous component-treated emulsion to recover the hydrocarbon. In various embodiments, the aqueous component is selected and contacted with the hydrocarbon-comprising emulsion in a manner and proportion so as to promote coalescence of the like phases while minimizing shear, which results in a decreased viscosity of the emulsion and a shift away from the emulsion inversion point or region toward a water-continuous state.

In various embodiments of the invention, the term "hydrocarbon" is used interchangeably with "oil". In various embodiments, the terms "hydrocarbon" or "oil" refer to any natural or synthetic liquid, semi-liquid or solid hydrocarbon material derived from oil and gas operations including crude oil operations in situ and ex situ, oil sands processing in situ and ex situ, biofuel operations, or any other industry in which it is necessary to recover the hydrocarbon from a hydrocarbon-comprising emulsion. The hydrocarbon in various embodiments includes, for example, hydrocarbon material having an API value of less than about 10°, heavy oil production (e.g., about 10 to about 22.3° API), medium oil production (e.g., about 22.3 to about 31.1° API), light oil production (e.g., >about 31.1° API), off shore oil production, natural gas operations, conventional oil, secondary and tertiary recovery, or biofuel. For example, in particular embodiments, the hydrocarbon may be "heavy oil", "extra heavy oil", or "bitumen" which refer to hydrocarbons occurring in semi-solid or solid form having a viscosity in the range of about 100,000 to over 1,000,000 cP measured at original in situ deposit temperature. In this specification, the terms "hydrocarbon", "heavy oil", "oil" and "bitumen" are used interchangeably. Depending on the in situ density and viscosity of the hydrocarbon, the hydrocarbon may comprise, for example, a combination of heavy oil, extra heavy oil and bitumen. Heavy crude oil, for example, may be defined as any liquid petroleum hydrocarbon having an API gravity less than about 20°, specific gravity greater than about 0.933 (g/ml), and viscosity greater than 100 cP. Oil may be defined, for example, as a hydrocarbon mobile at typical reservoir conditions. Extra heavy oil, for example, may be defined as having a viscosity of over 100,000 cP and about 10° API gravity. The API gravity of bitumen ranges from about 12° API to about 7° and the viscosity is greater than about 100,000,000 cP. In various embodiments where the hydrocarbon is derived from in situ oil sands operations, such operations include any in situ operation, including steam-based operations, solvent-based operations, oxidation/combustion-based operations or a combination thereof. Examples of such in situ thermal operations include Steam Assisted Gravity Drainage (SAGD), Expanding Solvent-SAGD (ES-SAGD), Cyclic Steam Stimulation (CSS), Steam Flooding (SF), Solvent-Assisted CSS (LASER), Toe-to-Heel-Air-Injection (THAI), or Solvent Aided Process (SAP).

In various embodiments of the invention, the term "hydrocarbon-comprising emulsion" refers to a heterogeneous mixture of two substantially immiscible liquid or semi-liquid phases wherein, for example, one phase is dispersed as small droplets in the second phase and where the droplets of the first phase have a reduced tendency to coalesce or collide with each other such that the two phases do not spontaneously separate. In various embodiments, one phase of the hydrocarbon-comprising emulsion comprises the hydrocarbon and the other phase comprises water. In various embodiments, the hydrocarbon, water (aqueous phase) or both may further comprise various contents of other chemical species such as, for example, various contents of gases (e.g., hydrogen sulfide), organosulfur and inorganic sulfur compounds, various salts, salt-forming species, organometallic and inorganic species, surfactants, surfactant precursors, solids (e.g., fines such as clays, sand particles), diluents or processing additives, or a combination thereof. These chemical species may be present as dissolved, dispersed or bound within the hydrocarbon, water or both. The presence of such chemical species can contribute to the chemical complexity of the hydrocarbon-comprising emulsion (e.g., heterogeneity of the emulsion) as such species can stabilize the emulsion making it difficult to break in order to recover the hydrocarbon. In various embodiments, heterogeneity of the hydrocarbon-comprising emulsion may arise not only from the source of the hydrocarbon but also from any processing techniques the emulsion is subjected to prior to the treatment with the aqueous component according to the various embodiments of the invention.

In various embodiments, depending on the source of the hydrocarbon-comprising emulsion, the chemical and physical makeup of the hydrocarbon-comprising emulsion can continuously change. For example, in embodiments in which the hydrocarbon emulsion is produced in situ from a bituminous reservoir, the properties and porosity of which may be variable, in combination with the manner in which the hydrocarbon-comprising emulsion is generated in situ, the emulsion may have variable properties. For example, the hydrocarbon-comprising emulsion produced by a Steam Assisted Gravity Drainage (SAGD) process is typically a chemically complex and "tight" emulsion as compared to a crude oil emulsion which is generally considered to be a "loose" emulsion. A SAGD-derived emulsion is typically a water-in-oil-in-water emulsion, although other emulsion types may also be present. Such an emulsion consists of extremely small water droplets emulsified in larger oil droplets in a water continuous external phase. The hydrocarbon-comprising emulsion produced from a thermal in situ process such as SAGD can also comprise a high asphaltene content, and thus be stabilized by such species. During production, the emulsion is subjected to high shear forces (e.g., through reservoir steaming, contacting with well bore liners, electrical submersible pumps, gas lift or a combination thereof) and mixing, which result in "tight" difficult to break emulsions. For example, the hydrocarbon-comprising emulsion derived from SAGD typically comprises highly sheared droplets ranging in size from about 1 μm to about 100 μm, from about 1 μm to about 50 μm. The hydrocarbon-containing emulsion derived from in situ operations such as, for example, SAGD may further comprise gas from the reservoir entrained in the emulsion, sand, clays and other chemical species (e.g., natural or added surfactants). The manner in which the hydrocarbon-comprising emulsion, such as a SAGD emulsion, is produced (e.g., exposure to high shear, high temperatures and pressures (e.g., about 130° C. to about 200° C. and about 1000 kPag to 2000 kPag) and pH (e.g., about 6.5 to about 10, about 6.5 to about 7) contribute to creating a difficult to break emulsion. This is in contrast to hydrocarbon-comprising emulsions that may result from crude oil operations. Crude oil emulsions are generally simple "loose" emulsions (e.g., oil-in-water or water-in-oil) which are less difficult to break. In various embodiments, addition of an aqueous component can still be beneficial for processing of "loose" emulsions. In particular embodiments where the hydrocarbon-comprising emulsion is derived from in situ operations such as SAGD, the heterogeneous nature of the emulsion further arises because the emulsion is typically a combination of emulsions from various SAGD wells from various well pads that may be located in different regions of the bituminous reservoir, produced from wells at different stages of SAGD operations, or a combination thereof. The produced emulsions, having highly variable chemical and physical properties, may be further affected by pipeline transport conditions. For example, the hydrocarbon-comprising emulsion derived from SAGD can vary in composition and properties both laterally along the length of the pipeline and through any given cross section (e.g., comprise slugs of high viscosity inverted emulsions).

In various embodiments, the hydrocarbon-comprising emulsion and the aqueous component-treated emulsion are described as having a "water cut". In various embodiments, the term "water cut" refers to a fraction of water in the hydrocarbon-comprising emulsion or the aqueous component-treated emulsion relative to the total volume of the hydrocarbon-comprising emulsion or the total volume of the aqueous component-treated emulsion. In various embodiments, the water cut of the hydrocarbon-comprising emulsion will vary depending on the source of the emulsion. In various embodiments, the hydrocarbon-comprising emulsion is an emulsion that has not been dewatered prior to treatment with the aqueous component so as to reduce the content of water relative to the content of the hydrocarbon (i.e., water cut). In various embodiments, the hydrocarbon-comprising emulsion refers to a bulk emulsion rather than a localized emulsion layer (e.g., a rag layer) formed during a separation process. In various embodiments, the aqueous component addition can also be used to treat rag layer. For example, in various embodiments, the rag layer may be preferentially treated by recycling upstream of the aqueous component addition in order to subject the rag layer to treatment with the aqueous component (e.g., recycle water) along with the bulk emulsion. In various other embodiments, the rag layer can also be slipstreamed with an aqueous component added into the rag stream, prior to being recycled back to a FWKO or treater, depending on what is practical or economically feasible for the process and facility design. In particular embodiments, for example, the rag-layer, the aqueous component-treated emulsion which has been reduced or minimized by the treatment with the aqueous component (i.e., remaining or residual aqueous component-treated emulsion) or both may be processed in, for example, a separator such as FWKO, a treater or both. In various embodiments, the process and system of the present invention may also be applied to an intermediate hydrocarbon-comprising emulsion, or an intermediate aqueous component-treated emulsion which have been previously pretreated to some extent at various stages of the hydrocarbon recovery. Pretreatment may include physical and chemical treatments such as, for example, initial separation or fractionation, including separation of solids, addition of a diluent, or cooling. In various embodiments, the addition of the diluent is preferably performed following the contacting of the hydrocarbon-comprising emulsion with the aqueous component because the diluent is more effectively dispersed within the resultant aqueous component-treated emulsion as compared to the hydrocarbon-comprising emulsion as a result of the treatment with the aqueous component.

One aspect associated with the water cut of the hydrocarbon-comprising emulsion or the aqueous component-treated emulsion is an emulsion inversion point or region. The emulsion inversion point or region relates to the water cut of the emulsion at or in the vicinity of which the emulsion can invert (i.e., the disperse phase becomes the continuous phase and vice versa) (e.g., FIG. 2). Furthermore, the water cut and the inversion point or region are related to a viscosity of the emulsion and may be modulated by a number of factors, including diluent or chemical addition, addition of the aqueous component (e.g., water) or a combination thereof as is illustrated for example in FIGS. 3 and 4. There can be a significant increase in the viscosity of the bulk hydrocarbon-comprising emulsion at the point or region of inversion of the continuous phase. In various embodiments, the water cut of the hydrocarbon-comprising emulsion will vary depending on the source of the emulsion and complexity. For example, the hydrocarbon-comprising emulsion produced from an in situ thermal process such as SAGD (e.g., a water-in-oil-in-water emulsion) may have a water cut of about 40% to about 85% water which is very close to the inversion point or region of this emulsion.

Figure 3:
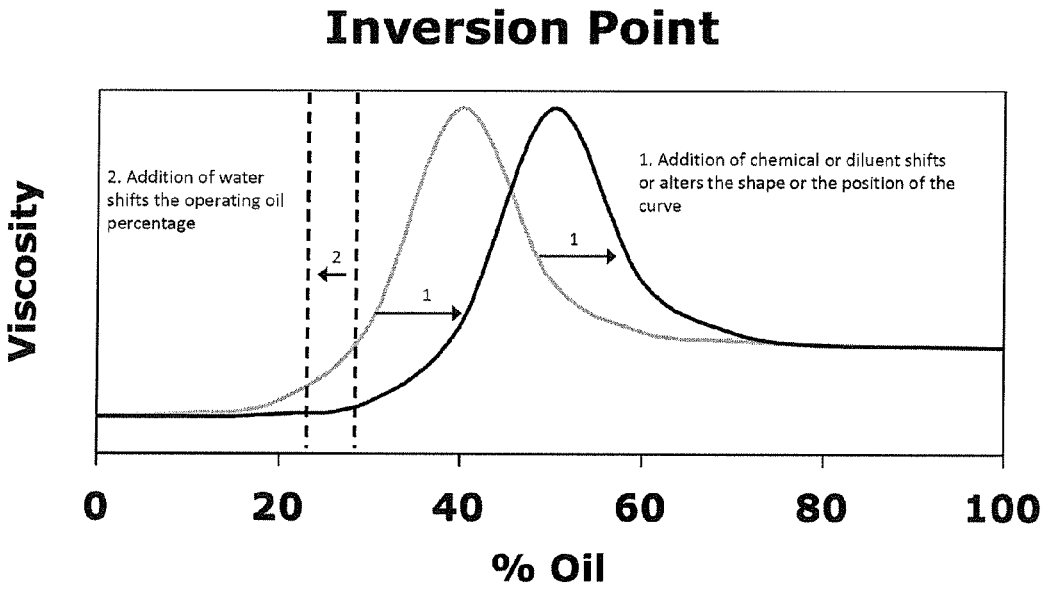
FIG. 3 illustrates factors which may influence the occurrence of the emulsion inversion point or region, limited to show water and chemical for instructive purposes.

FIG. 3 illustrates 1) operating on the edge of inversion point or region, with oil cut occasionally increasing to the point that operations are on the higher point of viscosity curve;
2) with chemical and diluent injection, the inversion curve was shifted—now operating on a lower part of the curve consistently with less opportunity to cross inversion point or region;
3) with water recycle (i.e., the aqueous agent), operations can move further down the viscosity curve to achieve similar results; and
4) because of the complexity of the hydrocarbon-comprising emulsion, the characteristics of the viscosity curve and where the inversion point or region lies for such a complex heterogeneous emulsion, and many other contributing factors, periodic sampling or dynamic monitoring of the hydrocarbon-comprising emulsion may be needed in various embodiments to test the extent to which operation can shift along the curve to achieve the various advantages.

Figure 4:
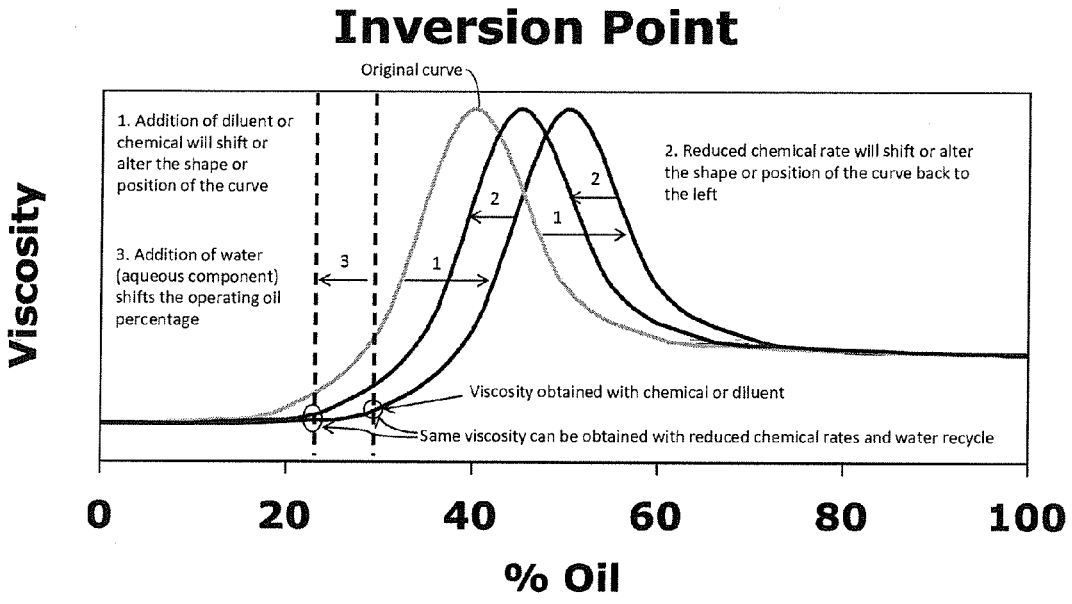
FIG. 4 illustrates the effects of chemical injection and addition of the aqueous component (e.g., water recycle) on the occurrence of the inversion point or region.

FIG. 4 illustrates that a chemical processing aid rate, a diluent rate or both can be reduced to shift or alter the curve, with compensation for reduced chemical or diluent rates by aqueous component agent to ensure operation on the lower viscosity region of the curve.

In various embodiments, factors which can influence the nature and behavior of the hydrocarbon-comprising emulsion, and also the emulsion inversion point or region include for example: relative quantities of the two components (hydrocarbon and water), quantities of other chemical species (e.g., emulsion stabilizers) in the hydrocarbon-comprising emulsion, ratio of viscosity of the two main components (hydrocarbon and water), shear history, solids content, pH, oil composition, droplet size distribution, flow regime through piping, hysteresis of the inversion point relationship, interfacial surface tension, temperature change or a combination thereof. As the relative quantity of the two main emulsion constituents (i.e., hydrocarbon and water) varies, and also as the other potential "triggers" change, the continuous phase may switch from one constituent to the other (i.e., a switch from oil being the continuous phase to water being the continuous phase or visa versa) and result in an increase in viscosity. Hydrocarbon recovery operations in the vicinity of the region of the emulsion inversion point or region can experience, for example, a reduction in facility capacity (e.g., vessel residence time), hydraulic limitations (e.g., pressure drop), temporary exchanger fouling, significant difficulty in breaking the emulsion, unpredictable and unstable process operation, poor water/hydrocarbon separation, poor gas separation (e.g., for streams that include dissolved or dispersed gases) or a combination thereof. In various embodiments, these problems may be particularly prevalent in SAGD operations and SAGD-derived emulsions with a lower steam-oil ratio (SOR), and hence lower water cut of the hydrocarbon-comprising emulsion. In particular embodiments, the inversion point or region for a SAGD-derived hydrocarbon-comprising emulsion may range, for example, between about 15% to about 60% oil. The inversion point for a complex emulsion such as a SAGD-derived emulsion is not fixed due to the highly variable (time dependent) production profile from the various pads and wells in the bituminous reservoir. For example, there may be wells at different stages of operation (e.g., new wells starting production, wedge wells typically producing lower water cuts), variability of hydrocarbon composition on a well to well basis or from the same well as time varies, effects of feeding the hydrocarbon-comprising emulsion though a complex gathering system or a combination thereof resulting in a heterogeneous hydrocarbon-comprising emulsion.

In various embodiments, the hydrocarbon-comprising emulsion to be treated with the aqueous component according to the various embodiments of the invention may have initial viscosities ranging from about 0.1 cP to about 100 cP. In particular embodiments, a SAGD-derived hydrocarbon-comprising emulsion may have initial viscosities ranging from about 0.1 cP to about 1000 cP.

In particular embodiments in which the hydrocarbon-comprising emulsion is derived from SAGD operations, the hydrocarbon-comprising emulsion may have a temperature ranging from about 130° C. to about 200° C.

In various embodiments, to determine how much of the aqueous component should be contacted with the hydrocarbon-comprising emulsion, the hydrocarbon-comprising emulsion may be monitored by obtaining samples of the emulsion according to a selected schedule for analysis, or by dynamically monitoring and analysing the emulsion (e.g., in real time). In various embodiments, the hydrocarbon and water content of the hydrocarbon-comprising emulsion may be measured at selected locations within the processing circuit (e.g., inlet to the degasser, inlet to the separator). In various embodiments, an excess of the aqueous component may be contacted with the hydrocarbon-comprising emulsion. In such embodiments, a maximum overcompensatory amount of the aqueous component may be determined for treating the particular hydrocarbon-comprising emulsion such that downstream operations are not negatively impacted (e.g., downstream separators such as FWKOs).

In this specification, the term "aqueous component" refers a water-comprising or water-based component. In various embodiments, the aqueous component has some salinity but it is not saturated (e.g., <about 1000 ppm). Because the aqueous component has a relatively low salinity, its effect on the hydrocarbon-comprising emulsion is not dependent on modulating the water density (differential density between water and the hydrocarbon phase) in the hydrocarbon-comprising emulsion to encourage the water to drop out of the emulsion to achieve separation. In various embodiments, the aqueous component is generally compatible with the hydrocarbon-comprising emulsion (i.e., addition of which does not make the hydrocarbon-comprising emulsion tighter). In various embodiments, the aqueous component is water. In this specification, the term "water" is used interchangeably with the term "aqueous component", and may comprise other dissolved or dispersed species, may be derived from a fresh water source or from produced water (e.g., recycled process water).

In various embodiments, the aqueous component (e.g., water) may be derived from a single source or a variety of water sources in combination. For example, in various embodiments, the aqueous component may be derived from, for example, a primary water separation stage (or as close to this point as practically possible) to ensure compatibility (e.g., not making the emulsion tighter) with the hydrocarbon-comprising emulsion and to improve water use efficiency. Additional benefits of using recycled water from, for example, the primary water separation stage relates to the benefit of recycling unused chemicals which have remained in the water, the water having a suitable temperature or a combination thereof. In various embodiments, the composition of the aqueous component may be modulated for treating a particular hydrocarbon-comprising emulsion to efficiently achieve the target aqueous component-treated emulsion (for example by addition of chemical species such as demulsifies, modulating the temperature).

In various embodiments, the aqueous component may have any suitable temperature so long as suitable contacting with the hydrocarbon-comprising emulsion may be achieved and desired properties of the aqueous component-treated emulsion may be achieved, namely a balance between a sufficient stability to pass through the degasser, the heat exchanger or both as an emulsion without passing though an emulsion inversion point and sufficient instability to break down into the hydrocarbon and water constituents for separation downstream of the heat exchanger. Depending on the source, the aqueous component may have a temperature ranging from about 50° C. to about 190° C. In various embodiments, the lower temperature limit of the aqueous component is governed by the beneficial effects of increased water cut and increased coalescence out weighing the negative effects of cooling the aqueous component treated hydrocarbon-comprising emulsion. In various embodiments, the upper temperature limit is generally governed by limiting the flashing to vapour phase of the aqueous component as it is added to the hydrocarbon-comprising emulsion, flashing aqueous component to vapour phase would cause shear on the hydrocarbon-comprising emulsion.

In various embodiments, the amount of the aqueous component to be contacted with the hydrocarbon-comprising emulsion can be tailored to the particular composition and properties of the hydrocarbon-comprising emulsion. In various embodiments, the amount of the aqueous component to be added is such that the aqueous component-treated emulsion has a viscosity lower than a viscosity of the hydrocarbon-comprising emulsion and is a substantially stable water-continuous emulsion. In various embodiments, the aqueous component-treated emulsion may comprise a content of the aqueous component such that a water content in aqueous component-treated emulsion ranges from about 40% to about 95%. In particular embodiments, for example in SAGD processes, the aqueous component-treated emulsion may comprise a content of the aqueous component such that a water content in aqueous component-treated emulsion ranges from about 80% to 95%. In various embodiments, the content of the aqueous component in the aqueous component-treated emulsion is such that the aqueous component-treated emulsion is sufficiently stable to pass through a degasser, a heat exchanger, a combination of the degasser and the heat exchanger as an emulsion without passing though an emulsion inversion point or region (e.g., without inverting from, for example, an oil-in-water emulsion to a water-in-oil emulsion and thus increasing in viscosity) while being sufficiently unstable to break down into the hydrocarbon and aqueous constituents in downstream processing (e.g., in a separator).

In various embodiments, the aqueous component may be contacted with the hydrocarbon-comprising emulsion at various stages of the hydrocarbon recovery process or at a combination of various stages for treating an intermediate hydrocarbon-comprising emulsion or an intermediate aqueous component-treated emulsion depending on the process requirements. As is illustrated in the example embodiments below, the process and method of the present invention allow to control the occurrence of the high viscosity event (i.e., inversion of the emulsion at the emulsion inversion point or region) in a location of choice (e.g., a location where such change in the viscosity will not have a substantially negative impact on the processing circuit). In various embodiments, the contacting points in the particular processing circuit may be selected depending on the process and what diluent, chemical injection or other requirements there may be. The aqueous component may be contacted with the hydrocarbon-comprising emulsion, the intermediate hydrocarbon-comprising emulsion or the intermediate aqueous component-treated emulsion at a single contact point or via a staged approach where several contacting locations may be selected. In various embodiments, addition of other process aids (e.g., diluent, chemical processing aids), if required, may also be performed at a single or multiple locations in the processing circuit to obtain any synergistic effects that may arise from the addition of such process aids aside from the addition of the aqueous component. The embodiments below present by way of example only various circuit configurations showing various contacting points for the aqueous component and any process aids.

For example, in selected embodiments, contacting of the aqueous component with the hydrocarbon-comprising emulsion (e.g., recycled water) upstream of a degasser may be preferred. In this embodiment, maximum gas removal from the aqueous component-treated emulsion may be realized in the inlet degasser, as well as downstream benefits such as reduced pressure drop and improved heat transfer across a heat exchanger, reduced separation problems in an emulsion separator, treaters or a combination thereof, and enhanced dispersion of chemical processing aid and diluent in the aqueous component-treated emulsion (increased chemical/diluent efficiency). In various embodiments, a demulsifier may also be added upstream of the degasser to further aid in promoting coalescence. An example of such an embodiment is illustrated in FIG. 5.

Figure 5:
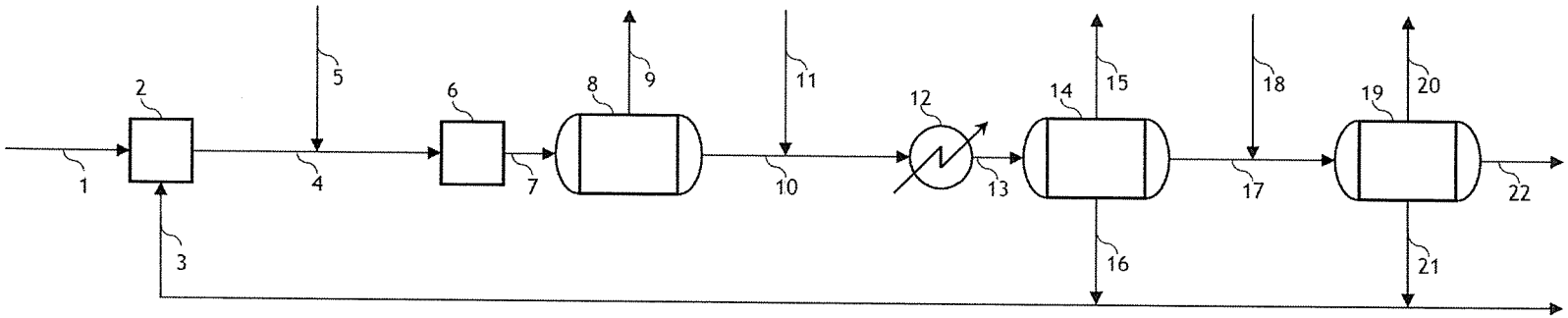
FIG. 5 illustrates a system for contacting the aqueous component with the hydrocarbon-comprising emulsion upstream of an inlet degasser according to an embodiment.

As is shown in FIG. 5, the hydrocarbon-comprising emulsion (1) is contacted with the aqueous component (e.g. recycled water (3)) via a low shear water contacting device (2). The resultant aqueous component-treated emulsion (4) having an increased water cut as compared to the hydrocarbon-comprising emulsion (1) is then optionally treated with chemicals (5) and fed through a mixing device (6) to promote mixing and coalescence with as little shear as possible. This pre-conditioned aqueous component-treated emulsion (7) is then fed to an inlet degasser (8) where gas is substantially removed (9). The degassed aqueous component-treated emulsion (10) is then treated with diluent or chemical (11) (optional) and directed to a heat exchanger (12) where it is cooled to prevent the diluent light ends from flashing in the downstream process vessels. In various embodiments, the degassed aqueous component-treated emulsion (10) may be cooled prior to the addition of the diluent. In the various embodiments, the emulsion may be cooled for several purposes including heat recovery for efficient and economical operation of the plant, minimization of water vapor generation as the pressure is reduced through the process, minimization of the diluent that is flashed to vapour phase, and thus minimization of diluent recovery equipment, or a combination thereof.

FIG. 5 further shows that the cooled aqueous component-treated emulsion (13) then flows to the next process vessel, such a for example a separator, the Free Water Knock Out unit (FWKO) (14). The FWKO unit is typically a large horizontal vessel which allows sufficient residence time to enable "free" coalesced water in the aqueous component-treated emulsion to separate by gravity from the emulsion and be removed. The produced water (16) is removed from the bottom of the vessel. The FWKO also allows any residual entrained gas (15) to evolve from the emulsion and exit from the top of the vessel. If an unresolved residual emulsion (17) remains in the FWKO, it may be further treated with any additional diluent/chemicals (18) (optional) required and directed to a treater vessel (19) to allow further residence time to separate into the main constituents of oil (22) and water (21). A common problem in a prior art process for treating the hydrocarbon-comprising emulsion in the FWKO and the treater vessels is the formation of an unresolved emulsion layer at the hydrocarbon/water interface in the vessel (i.e., a rag layer), which is difficult to treat and hinders coalescence of water and hydrocarbon droplets. The rag layer varies with the variability in the hydrocarbon-comprising emulsion. The rag layer may also hinder any further evolution of gas bubbles. The treatment of the hydrocarbon-comprising emulsion (i.e., bulk emulsion and not the rag layer itself) with the aqueous component according to the various embodiments reduces or eliminates the problems associated with the rag layer formation in the separator. Any further residual gas (20) evolved in the treater may exit from the top of the vessel. In various embodiments, the treater may have a pressure of about 1100 kPag, and therefore it is important to ensure that as much gas as possible is removed by reducing viscosity and reducing or eliminating the rag layer to promote gas liberation in the separator vessels.

As is further shown in FIG. 5, the produced water from the FWKO (16) and treater (21) may be collected into a common header. A portion of this water may be then recycled back to the inlet to make up the water recycle (3) while the rest may be cooled and sent to a water treatment unit (not shown). The produced gas may be collected in a header and sent to the produced gas system (not shown). While in various embodiments, the hydrocarbon-treated emulsion may contain solids, the solids may be separated in the inlet degasser, FWKO, the treater vessels or a combination thereof.

Figure 6:
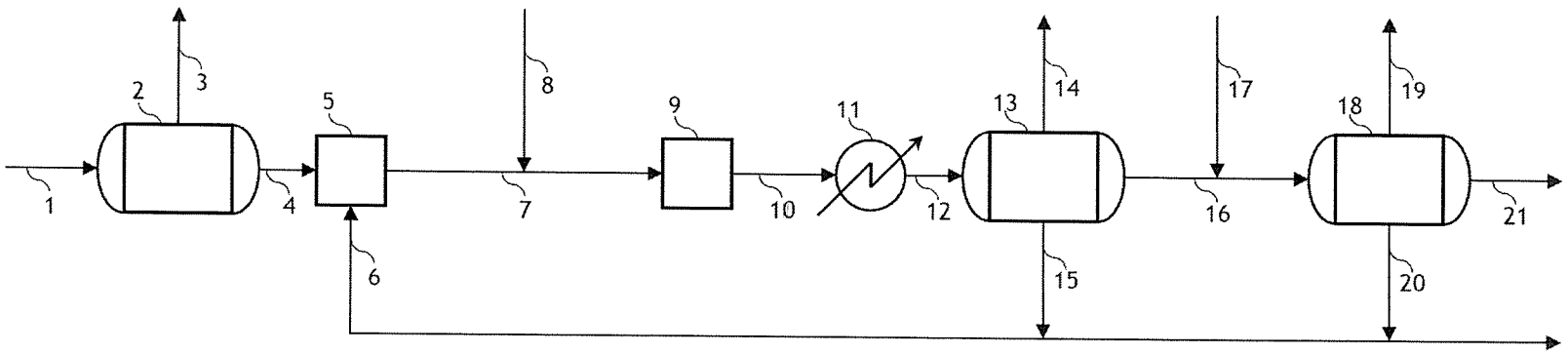
FIG. 6 illustrates a system for contacting of the aqueous component with the hydrocarbon-comprising emulsion upstream of a heat exchanger according to an embodiment.

In another embodiment, the aqueous component may be contacted with the hydrocarbon-comprising emulsion, the intermediate hydrocarbon-comprising emulsion, or the intermediate aqueous component-treated emulsion upstream of the heat exchanger as is illustrated for example in FIG. 6. In this embodiment, recycling water upstream of the heat exchanger will still prove beneficial, but will not address the problem of being unable to remove gas in the inlet degasser. However, removal of gas may not be necessary in some embodiments where the hydrocarbon-comprising emulsion does not contain substantial amounts of gas. Even if some gas is present in the hydrocarbon-comprising emulsion, this gas may be removed downstream, for example in the FWKO and the treater. In some embodiments where the quantity of gas is not substantial, disruption of the water-oil interface in these separation vessels and hindering separation would not be significant. In embodiments, were the amount of gas in the hydrocarbon-comprising emulsion is significant, the benefits seen in the heat exchanger, namely a reduced pressure drop and a reduced fouling tendency, will still be seen, as well as enhanced dispersion of diluent and chemicals even in the absence of the addition of the aqueous component to the hydrocarbon-comprising emulsion upstream of the degasser. Coalescence of water droplets will also occur, allowing water to drop out in the FWKO and the treater. The suitability of this embodiment could be tailored to the particular hydrocarbon-comprising emulsion to be treated to determine the impact, if any, of the gas in the vessels on separation.

In various embodiments, depending on the properties of the particular hydrocarbon-comprising emulsion to be processed, reduction in fouling of the heat exchanger is beneficial. For example, fouling may occur when the emulsion is a viscous complex emulsion (e.g., comprising slugs of hydrocarbon). Such an emulsion can coat the tubes of the heat exchanger resulting in restricted flow, reduced heat transfer and increased pressure drops. In various embodiments, adding diluent upstream of the heat exchanger may help reduce fouling (e.g., wash or dissolve away the coating layer from the heat exchanger tubes). Therefore in some embodiments, it may be beneficial to use diluent in addition to the aqueous component treatment. However, the process and system of the present invention do not depend on the use of the diluent as addition of the aqueous component addresses the problem of viscosity.

As is shown in FIG. 6, the hydrocarbon-comprising emulsion (1) is directed to the inlet degasser (2) where gas is removed (3). The degassed hydrocarbon-comprising emulsion (4) exits the inlet degasser and is contacted with the aqueous component (e.g., recycled water (6)) injected via a low shear water contacting device (5). The aqueous component-treated emulsion (7) increased in water cut as compared to the hydrocarbon-comprising emulsion is treated with chemicals and diluent (8) (optional) and fed through a mixing device (9) to promote mixing and coalescence with as little shear as possible. This pre-conditioned aqueous component-treated emulsion (10) is then fed to the heat exchanger (11). The emulsion is cooled to prevent the diluent light ends from flashing in the downstream process vessels. The cooled aqueous component-treated emulsion (12) then flows to the next process vessel such as the Free Water Knock Out (FWKO) (13), which allows sufficient residence time to enable "free" coalesced water to separate by gravity from the emulsion and be removed. The produced water (15) is removed from the bottom of the vessel. The FWKO also allows any remaining entrained gas (14) to evolve from the aqueous component-treated emulsion and exit from the top of the vessel. Any unresolved residual emulsion (16) remaining in the FWKO is further treated with any additional diluent/chemicals (17) (optional) required and flows to a treater vessel (18) to allow further residence time to separate into the main constituents of oil (21) and water (20). Any gas (19) evolved in the treater exits from the top of the vessel. Produced water from the FWKO (15) and treater (20) is collected into a common header. A portion of this water can then recycled back to the inlet to make up the water recycle (6) while the rest can be cooled and sent to water treatment unit (not shown). The produced gas can be collected in a header and sent to the produced gas system (not shown).

In various embodiments, the mixing device may or may not be required depending on the specific properties of the hydrocarbon-comprising emulsion. If the mixing device is required, in various embodiments, the contact angle for the mixing device may be selected such that it is a water wet device. In various embodiments, the material of construction for the mixing device may be selected so that it has a suitable surface wettability as this aspect may affect the phase inversion point of the emulsion. An example of a suitable materials for the mixing device is stainless steel as it has lower contact angles (<about 90°). In various embodiments, the orientation of the mixing device should also be preferentially oriented with it's longitudinal axis in the horizontal direction, which will facilitate minimizing the possibility of an unstable flow regime through the aqueous component addition device and the low shear static mixer if present.

Figure 7:
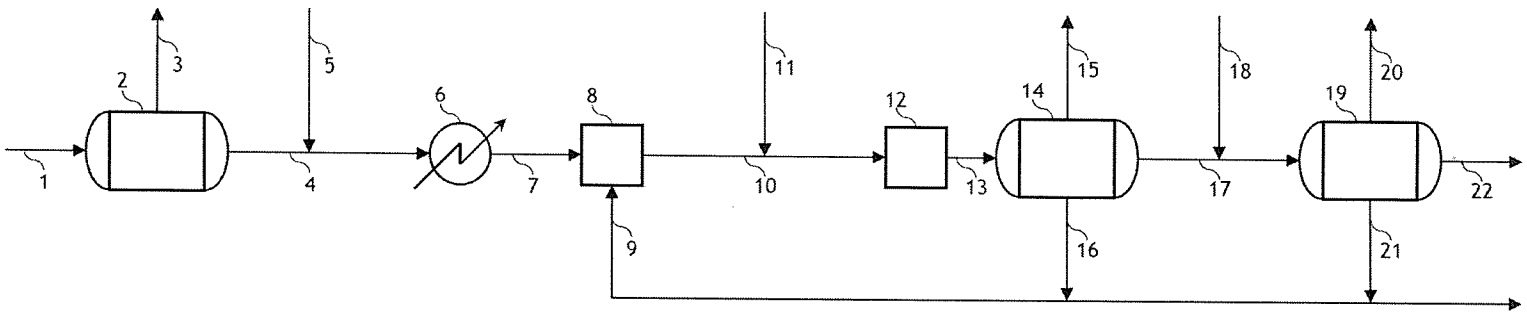
FIG. 7 illustrates a system for contacting of the aqueous component with the hydrocarbon-comprising emulsion upstream of a free water knockout unit (FWKO according to an embodiment)

In yet another embodiment, the aqueous component may be contacted with the hydrocarbon-comprising emulsion, the intermediate hydrocarbon-comprising emulsion, or the intermediate aqueous component-treated emulsion upstream of a separator (FIG. 7). In this embodiment, contacting the aqueous component (e.g., recycling water) upstream of the separator (e.g. FWKO) will continue to prove beneficial, however it may not facilitate removal of gas in the inlet degasser or reduced pressure drop and fouling in the heat exchanger as effectively as can be observed with the other embodiments discussed where the aqueous component is contacted with the hydrocarbon-comprising emulsion upstream of the inlet degasser or upstream of the heat exchanger, or upstream of both. Depending on the properties of the hydrocarbon-comprising emulsion to be processed, removal of gas or reduced pressure drop aspects may not be at issue. For example, if the hydrocarbon-comprising emulsion comprises a low content of gas, the carryover of this gas downstream to the separator (e.g. FWKO and treater) may not substantially affect the separation. In contrast in embodiments where the hydrocarbon-comprising emulsion comprises large quantities of entrained gas, this embodiment may be as beneficial as some of the other described embodiments as the presence of gas may disrupt the water-oil interface in these separation vessels and hinder separation. If the hydrocarbon-comprising emulsion to be processed is not very viscous, fouling of the heat exchanger may not be an issue. In contrast if the hydrocarbon-comprising emulsion has a high viscosity, this embodiment may not be preferred over the other embodiments discussed because the viscous emulsion may coat the heat exchanger tubes causing fouling, a reduction in heat transfer, as well as a restricted flow area, and result in increased pressure drop. Although enhanced dispersion of diluent and chemicals, as well as coalescence of water droplets will still occur in the case of a viscous hydrocarbon-comprising emulsion, process performance may be hindered due to gas in the downstream separation vessels.

As is shown in FIG. 7, the hydrocarbon-comprising emulsion (1) is fed to the inlet degasser (2) where gas is removed (3). The degassed hydrocarbon-comprising emulsion (4) exits the inlet degasser and diluent/chemicals are optionally added (5). The hydrocarbon-comprising emulsion then flows through a heat exchanger (6) where it is cooled to prevent the diluent light ends from flashing in the downstream process vessels. The cooled hydrocarbon-comprising emulsion (7) is then contacted with the aqueous component (e.g. recycled water (9)) via a low shear water contacting device (8). The resultant aqueous component-treated emulsion (10) having an increased water cut as compared to the hydrocarbon-comprising emulsion is treated with chemicals and diluent (11) (optional) and fed through a mixing device (12) to promote mixing and coalescence with as little shear as possible. This pre-conditioned aqueous component-treated emulsion (13) is then fed to the next process vessel, which may be a separator such as the Free Water Knock Out (FWKO) (14) which allows sufficient residence time to enable "free" coalesced water to separate by gravity from the emulsion and be removed. The produced water (16) is removed from the vessel. The FWKO also allows any remaining entrained gas (15) to evolve from the emulsion and exit from the top of the vessel. The unresolved residual emulsion (17), if any, remaining in the FWKO is further treated with any additional diluent/chemicals (18) (optional) required and flows to a treater vessel (19) to allow further residence time to separate into the main constituents of oil (22) and water (21). Any gas (20) evolved in the treater exits from the top of the vessel. Produced water from the FWKO (16) and treater (21) may be collected into a common header. A portion of this water may be then recycled back to the inlet to make up the water recycle (9) while the rest may be cooled and sent to water treatment unit (not shown). The produced gas is collected in a header and sent to the produced gas system (not shown).

Figure 8:
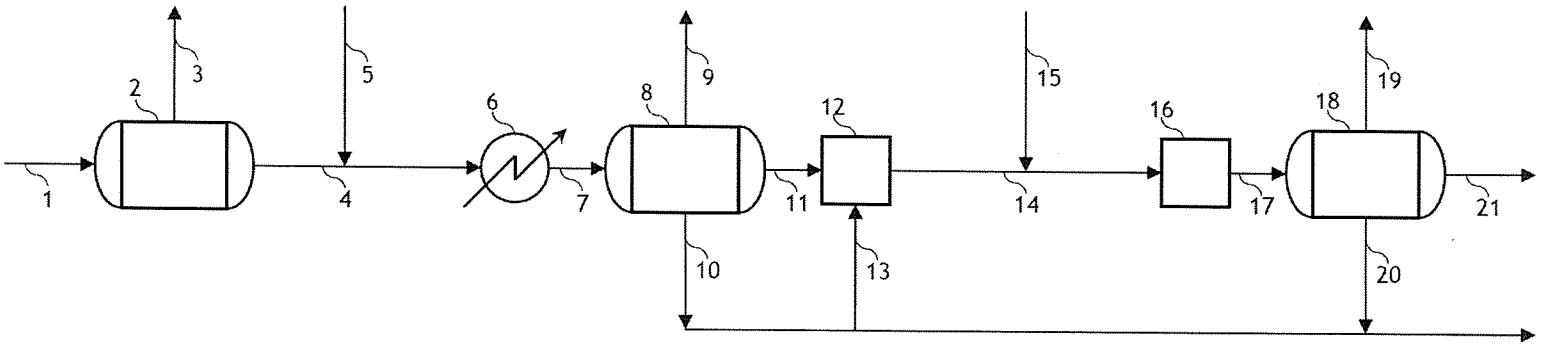
FIG. 8 illustrates a system for contacting of the aqueous component with an emulsion derived from the hydrocarbon-comprising emulsion upstream of a treater according to an embodiment.

In yet another embodiment, the aqueous component may be contacted with the hydrocarbon-comprising emulsion upstream of the treater as is shown in FIG. 8. This embodiment may be suitable for treating selected hydrocarbon-comprising emulsions, intermediate hydrocarbon-comprising emulsions, or intermediate aqueous component-treated emulsions where there may be no need to address problems relating to removal of gas (e.g., in the inlet degasser), reduction in pressure drop and fouling in the heat exchanger, separation and coalescence in the FWKO or a combination thereof. According to this embodiment, the contacting of the aqueous component with the hydrocarbon-comprising emulsion, the intermediate hydrocarbon-comprising emulsion, or the intermediate aqueous component-treated emulsion facilitates the dispersion of diluent and chemical to the treater, and enhances separation in the treater by promoting coalescence of water droplets. This embodiment may not be suitable for treating the hydrocarbon-comprising emulsion, the intermediate hydrocarbon-comprising emulsion, or the intermediate aqueous component-treated emulsion comprising gas in quantities where process performance could be hindered due to gas that has not been evolved upstream of the treater and has been carried to the treater because it may disrupt the water-oil interface.

As is illustrated in FIG. 8, the hydrocarbon-comprising emulsion (1) is collected and fed to the inlet degasser (2) where gas is removed (3). The degassed hydrocarbon-comprising emulsion (4) exits the inlet degasser and diluent/chemicals may be added (5) (optional). The emulsion then flows through a heat exchanger (6) where it is cooled to prevent the diluent light ends from flashing in the downstream process vessels. The cooled hydrocarbon-comprising emulsion (7) is then fed to the next process vessel, such as for example, the Free Water Knock Out (FWKO) (8) to enable "free" coalesced water to separate by gravity from the emulsion and be removed. The produced water (10) is removed from the bottom of the vessel. The FWKO also allows any remaining entrained gas (9) to evolve from the emulsion and exit from the top of the vessel. The hydrocarbon-comprising emulsion (11) flows from the FWKO and is contacted with the aqueous component (13) (e.g. recycled water) via a low shear water contacting device (12). The aqueous component-treated emulsion (14) having an increased water cut as compared to a water cut of the hydrocarbon-comprising emulsion is treated with chemicals and diluent (15) (optional) and fed through a mixing device (16) to promote mixing and coalescence with as little shear as possible. This pre-conditioned aqueous component-treated emulsion (17) is then fed to a treater vessel (18) to allow further residence time to separate into the main constituents of oil (21) and water (20). Any gas (19) evolved in the treater exits from the top of the vessel. Produced water from the FWKO (10) and treater (20) may be collected into a common header. A portion of this water may be then recycled back to the inlet to make up the water recycle (13) while the rest may be cooled and sent to water treatment unit (not shown). The produced gas may be collected in a header and sent to the produced gas system (not shown).

In embodiments in which, for example, the hydrocarbon-comprising emulsion is derived from an in situ process such as SAGD, the heat exchanger is typically a cooling heat exchanger. In such embodiments, the degasser is typically operated at higher than atmospheric pressure, which creates a different gas release environment as compared to degassers operated at atmospheric pressure.

In various embodiments, the aqueous component (e.g., water) is contacted with the hydrocarbon-comprising emulsion so as to destabilize the emulsion and initiate coalescing of like phases prior to separation. Furthermore, the aqueous component is contacted with the hydrocarbon-comprising emulsion so as to increase bulk emulsion water cut and thus move the point of operation away from the emulsion inversion point into the water continuous region and to achieve a sufficient dispersion of the aqueous component within the hydrocarbon-comprising emulsion to form the aqueous component-treated emulsion. In various embodiments, the contacting of the aqueous component (e.g., water) is effected in such a manner so as to not adversely shear the emulsion. When the contacting is performed under low shear conditions, improved coalescence of water drops to produce a more consistent/developed water continuous phase is achieved. According to the various embodiments, the process and system of the present invention facilitate imparting sufficient energy to allow or encourage the droplets in the hydrocarbon-comprising emulsion to collide and coalesce with the aqueous component without imposing additional shearing on the emulsion and exacerbating the emulsion problem. Thus the process and system of the present invention is related to modulation of the viscosity of the hydrocarbon-comprising emulsion by the addition of the aqueous component (and not by manipulation of the temperature) and diameter of droplets during coalescence (rather than manipulation of differential density of the phases, for example, by adding water having a high salt concentration).

Figure 9:
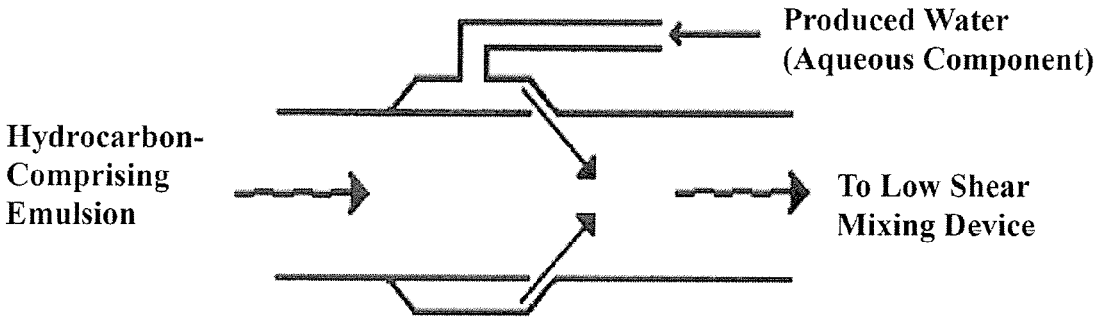
FIG. 9 illustrates co-current contacting of the aqueous component with the hydrocarbon-comprising emulsion in a vessel (e.g., in pipe) according to an embodiment.
Figure 10:
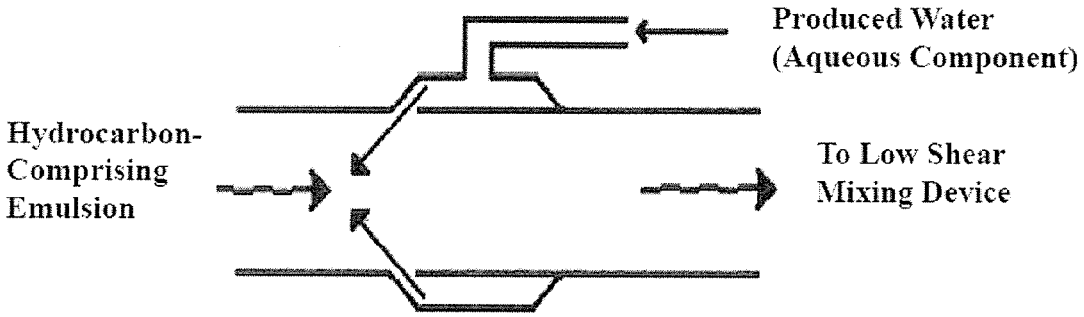
FIG. 10 illustrates counter-current contacting of the aqueous component with the hydrocarbon-comprising emulsion in a vessel (e.g., in pipe) according to an embodiment.
Figure 11A:
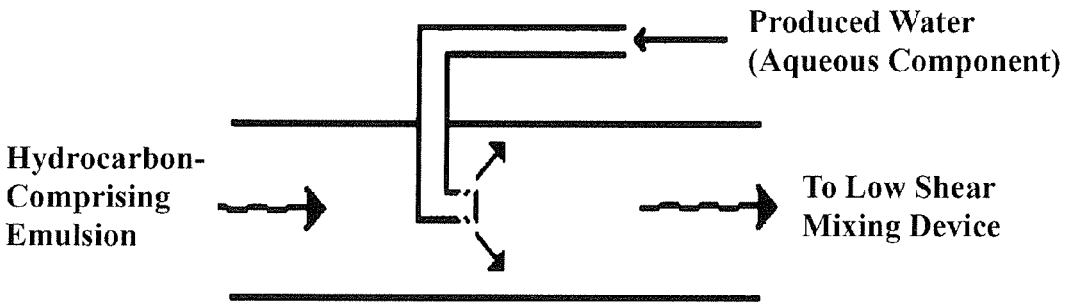
FIG. 11A illustrates co-current central contacting of the aqueous component with the hydrocarbon-comprising emulsion in a vessel (e.g., in pipe) according to an embodiment.
Figure 11B:
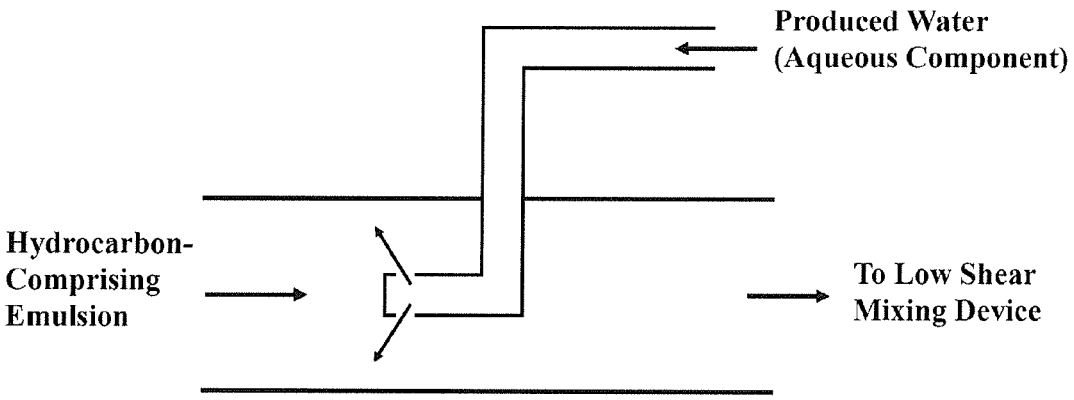
FIG. 11B illustrates counter-current central contacting of the aqueous component with the hydrocarbon-comprising emulsion in a vessel (e.g., in pipe) according to an embodiment.

In various embodiments, the geometry, velocity, overall volume of the aqueous component added or a combination thereof may be varied to optimize emulsion conditioning (e.g., destabilization and coalescence) to enhance downstream separation. In various embodiments, the contacting may be effected using various directional flows of aqueous component into the hydrocarbon-comprising emulsion. In various embodiments, the aqueous component is contacted with the hydrocarbon-comprising emulsion as a continuous stream. In various embodiments, this could also be carried out as a non-continuous aqueous component addition if the process is dynamically monitored in real time, and the aqueous agent is added only when the monitored water cut drops below a certain set point value. In various embodiments, the contacting may be effected using a co-current flow, a counter-current flow, a co-current central flow, counter-current central flow or a combination thereof as is illustrated in FIGS. 9 to 11. In various embodiments, the aqueous component may be dispensed using a low shear contacting device (e.g., a low shear injector). The aqueous component may be injected in pipe where dispersion of the aqueous component within the hydrocarbon-comprising emulsion can take place depending on the flow conditions, properties of the hydrocarbon-comprising emulsion or a combination thereof. For example, the aqueous component may be dispensed into the hydrocarbon-comprising emulsion as a spray or as a stream. In other embodiments, the hydrocarbon-comprising emulsion and the aqueous component may be mixed using a low shear mixing device configured to promote mixing and coalescence with as low shear as possible. For example, dispensing of the aqueous component, mixing or a combination thereof may be performed using low shear static mixers, injectors, nozzles or tank mixers with impellers, turbines, propellers or paddles, baffles, an inline device or other mechanical device with or without energy input without introducing adverse shear. The contacting of the aqueous component with the hydrocarbon-comprising emulsion according to the various embodiments, provides an additional control parameter to continuously optimize performance, for example, the volume of the aqueous component being added (e.g., water volume being injected). In various embodiments, in which the hydrocarbon-comprising emulsion is derived, for example, from an in situ thermal process such as SAGD, the emulsion is tight as compared to emulsions derived from other operations (e.g., crude oil) and therefore more challenging to process. Traditionally, processing of such an emulsion has been performed using high chemical dosages. The present process and system present an advantage over the prior art processing as they allow a reduction in the use of chemical processing aids. For example, in various embodiments, recirculation of the aqueous component (e.g., water) from the separator to treat the hydrocarbon-comprising emulsion may increase the effectiveness of injection of other chemical processing aids by allowing use of unspent chemical and increasing dispersion of chemical, thus allowing lower overall chemical cost dosages. In further embodiments, the process and system of the present invention may improve the effectiveness of removing solids from the emulsion (e.g., washing solids clear of the fluids).

As was described in the example embodiments above, the aqueous component-treated emulsion is separated into the hydrocarbon and water constituents in a separator. The process of separation is also referred to as "emulsion breaking" or demulsification over a demuslsification time period. The demulsification time period of the aqueous component-treated emulsion is lesser than a demulsification time period for the hydrocarbon-comprising emulsion. Based on Stokes Law, if the viscosity is reduced, the speed of separation will increase proportionally to this reduction. Furthermore, if the diameter of the droplet increases, the speed of separation will increase in proportion to the square of the factor in which the diameter is increased. In this context, demulsification of the hydrocarbon feed is necessarily a matter of degree, reflecting the extent to which demulsification proceeds to complete resolution of hydrocarbon and aqueous phases. As used herein, the term "demulsification" is used to mean that a generally distinct aqueous phase is resolved from the hydrocarbon phase. Although a proportion of the aqueous phase may remain emulsified, the emulsion has been broken to the extent that it gives rise to a distinct aqueous phase and a distinct hydrocarbon phase. In various embodiments, the demulsification time period of the hydrocarbon-comprising emulsion is variable depending on emulsion properties and equipment configuration. The demulsification time period can range from minutes to hours or even days if the emulsion is very tight. In some embodiments, the demulsification time period of the aqueous component-treated emulsion (i.e., a modified demulsification time) may be shorter than the demulsification period of the hydrocarbon-comprising emulsion by a factors ranging up to several orders of magnitude if viscosity and droplet diameter are successfully manipulated by the aqueous agent and the effect of coalescence.

Figure 12:
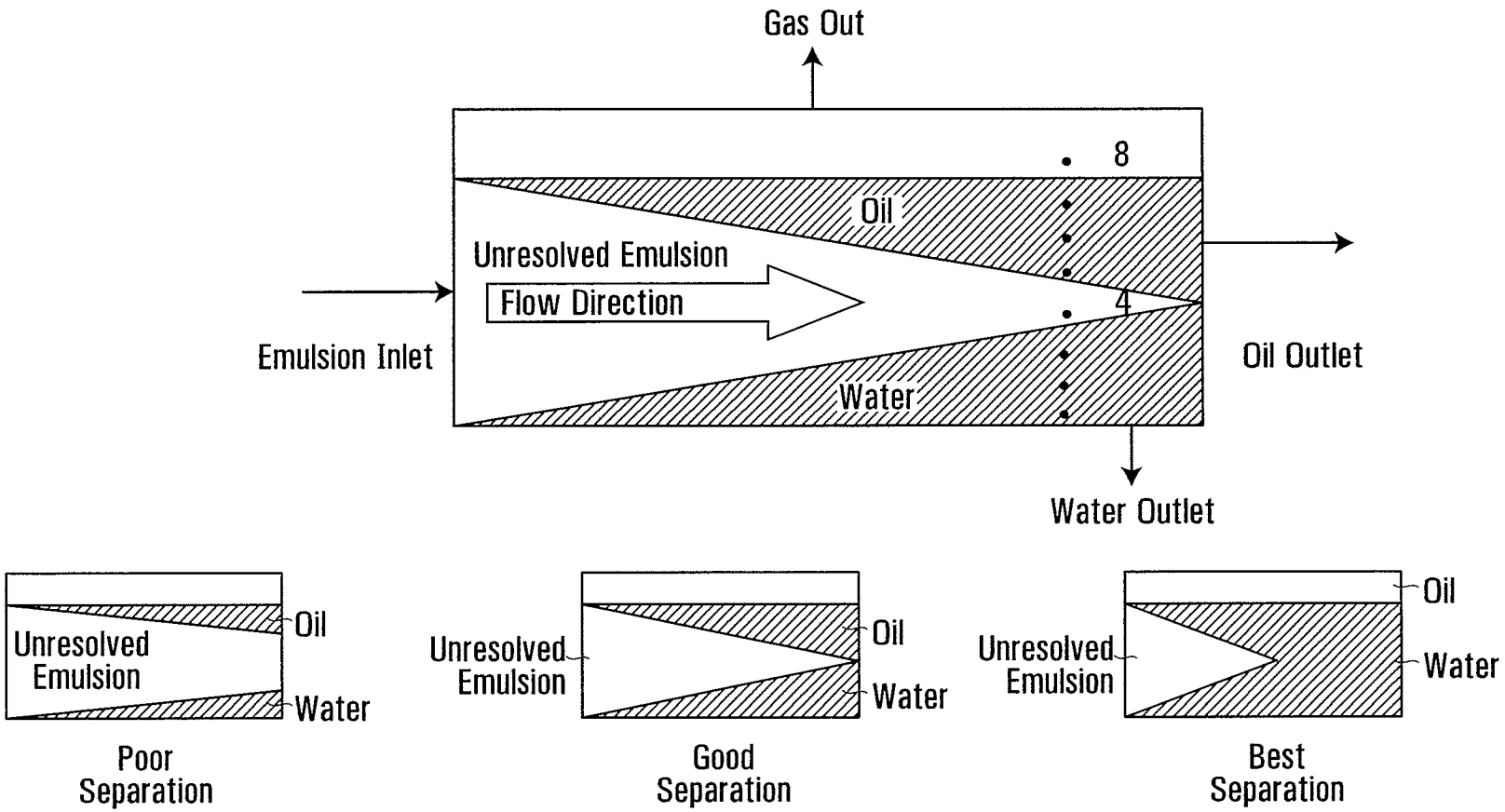
FIG. 12 illustrates principles of operation of the free water knockout unit (FWKO) and examples of various separation profiles that may result.

For example, FIG. 12 illustrates the operation of the FWKO unit and how it can be affected by induced coalescence resulting from the treatment of the hydrocarbon-comprising emulsion with the aqueous component. The purpose of induced coalescence resulting from the treatment of the hydrocarbon-comprising emulsion with the aqueous component according to the various embodiments of the invention is to use velocity, directional change, or imparted energy to increase speed and effectiveness of coalescing, destabilize droplet surface to be coalesced (disruption of surfactants or fine solids), increase water contact surface area from higher water volumes (when free water volume is greater, more large droplets coalesce), make use of residual chemical in the water stream (i.e., the aqueous component) or a combination thereof. Another indication of a more efficient demulsification of the aqueous component-treated emulsion may be the thickness of the rag layer as compared to the thickness of the rag layer obtained from the hydrocarbon-comprising emulsion. In various embodiments, the quality of the outlet streams from the separation vessels will also indicate more efficient demulsification. For example, with efficient demulsification, there will be less oil in the produced water outlet stream, less water in the emulsion or oil outlet streams, and enhanced (increased) gas liberation from the separation vessels. The addition of the aqueous component to the hydrocarbon-comprising emulsions according to the various embodiments to recover the hydrocarbon presents several advantages including hydrocarbon rate of separation acceleration, enhanced (increased) recovery, enhanced economics or a combination thereof. Examples of separators suitable for the use in various embodiments of the present invention include conventional separators such as for example a gravity separator (e.g., a vessel or tank), an inclined plate separator.

In embodiments in which some unresolved residual emulsion remains, this emulsion may be further treated in a treater. In various embodiments, the treater may be a simple gravity separation type, include electrostatic grids for enhanced (increased) oil/water separation performance or a combination thereof.

In various embodiments, the process and system of the present invention may be implemented into an existing processing circuit (for example as a debottleneck option) or as a new design. In embodiments where the process and system of the present invention are implemented into an existing processing circuit, the particulars of implementation will be dependent on the existing system configuration and operation. For example, in various embodiments, the hydraulic limit of the system may need to be calculated or estimated to determine if the required quantity of the aqueous component (e.g., water recycle or water addition from external sources) is within the system limitations. Since there are many possible factors which could limit the addition of the aqueous component (e.g. water recycle rate) such as, for example, line hydraulics, pump capacity, pump head, control valve sizing, vessel residence time, equipment dimensions, or a combination thereof, the specific implementation should include a careful evaluation of the system. In particular embodiments, examples of specific limitations that may be encountered include reduced residence time in the inlet degasser due to increased total fluid throughput. In such embodiments, the aqueous component addition (e.g., water recycle) may be increased to a point where gas liberation is maximized for the specific system design configuration. Increasing the aqueous component rate (e.g., water recycle rate) beyond this point may reduce the residence time or conflict with other vessel design features and potentially cause degradation in the gas removal performance beyond this "optimum" point. In some embodiments, there may be exchanger limitations such as facility heat integration considerations, pressure drop increase (due to increased hydraulic throughput), vibration or erosion limits or a combination thereof that should be considered.

In various embodiments, the operation of the separator (e.g., the Free Water Knock Out (FWKO)) may also need to be evaluated to determine any operational limits reached due to increased water and total fluid throughput. For example, in the FWKO with water recycle as the aqueous component (e.g., using water recycle upstream of inlet degasser or upstream of FWKO or upstream of both the inlet degasser and the FWKO), hydrocarbon and water separation will be enhanced (increased) up to a maximum point, where additional water recycle may not provide immediate benefit as vessel residence time and the physics defining the speed of phase (gas, hydrocarbon, water) separation becomes limiting. In such an embodiment, the system and process may be designed such the equipment operational limits may be compensated for by other downstream equipment. Such modifications should be evaluated on a case by case basis.

In various embodiments, other considerations the that may be taken into account include, for example, physical limitations within the facility, available pipe rack space, tie-in location, existing control scheme or logic or some other factors which would not allow contacting of the aqueous component (e.g., water injection) at one or more of the preferred locations (e.g., upstream of the inlet degasser, upstream of the exchanger(s), upstream of the FWKO). In embodiments, in which the preferred or optimum aqueous component contacting (e.g., water injection) location is not available, the aqueous component could be added at an alternate location deemed to be the best available compromise for the particular processing circuit. In various embodiments, if more practical, an existing injection or recycle line (if some other product is injected or recycled) into an acceptable location may be chosen. One consideration may involve a determination of whether the recycle water (aqueous component) is compatible with the pre-existing injection or recycle material.

In various other embodiments, the process and system of the present invention may be a new design facility. In various embodiments, in this implementation, the preferred location of the contacting of the aqueous component with the hydrocarbon-comprising emulsion (e.g. water addition) may be upstream of the inlet degasser, alone or in combination with provisions for the addition of the aqueous component into a location upstream of the separator (e.g. FWKO). A factor to be considered in the various embodiments of this implementation includes, for example, the intended maximum quantity of the aqueous component (e.g. recycled water) for the initial design of the vessels and piping systems so as to account for the increase volume of liquid which must be handled, which includes consideration of system hydraulics and instrumentation control philosophy and logic. The preferred location of the contacting of the aqueous component (e.g, water injection) with the hydrocarbon-comprising emulsion and chemical injection may be upstream of the inlet degasser and upstream of the FWKO, although other contacting locations could be selected based on actual plant configuration to achieve the same result and effect on the emulsion. Diluent injection, if required for the process, may be effected upstream of the exchanger or upstream of FWKO. The preferred location for diluent addition may be upstream of the heat exchanger in order to aid in viscosity reduction and prevent fouling in the exchanger. In various embodiments, the exact location would be dependent on process conditions and fluid properties. Implementation of the process and system of the present invention to a new facility can facilitate increased emulsion treating capacity throughput for a given equipment size by reducing the necessary residence time for separation to occur, reduced equipment size for a given throughput as compared to a design which does not include this method or a combination thereof.

In various embodiments, for example, in which the new process is designed or an existing process has already been designed to use a range of diluents which may be selected for use from time to time, based on availability or other economic factors. The diluents to be used could range from a synthetic crude to a much lighter hydrocarbon such as condensate, for example. In the case of synthetic crude being used as a diluent in the process, the addition of an aqueous agent to reduce the overall emulsion viscosity (due to the heavier synthetic crude diluent being used) would be beneficial.

In various embodiments, for example, in which the process and system of the present invention are implemented into either an existing facility or a new facility, and in which recycled aqueous component is used (e.g., water recycle), the recycling may be modulated in a number of ways. In selected embodiments, modulation of the contacting of the aqueous component with the hydrocarbon-comprising emulsion (e.g. water injection control) may include a fixed water rate, a variable water rate or a combination of these control methods. For the fixed water recycle rate, the preferred method may involve a determination of the minimum desired water recycle rate to achieve the altered emulsion viscosity curve, while considering the possible equipment limitations (e.g., hydraulic throughput limits), and recycle this fixed quantity of water regardless of the inlet emulsion rate or emulsion condition. A design margin may be added to the water recycle flow rate to ensure the emulsion is always operating in the water continuous phase. In various other embodiments, the flow rate of the aqueous component (e.g., water flow rate) may also be varied based on a fixed ratio of total emulsion inlet flow to required water recycle rate, or the water recycle rate could be varied on a combination of inlet emulsion water cut (e.g., determined via manual sample, automatic measurement, or material balance methods) to total emulsion inlet rate. In various embodiments, this method of dynamic control may be desirable in the case of a facility in which the process and system of the present invention are retrofit to remain within the equipment limitations. In various embodiments, feed forward or feedback control may be implemented based on historical or predicted inlet conditions and anticipated dynamic response of the control system.

Examples of advantages provided by the process and method of the present invention relate to:

(1) economic benefits arising from recycling any residual chemical in the produced water (aqueous component), e.g., reduction in consumption of chemical processing aids typically employed in breaking hydrocarbon emulsions;

(2) lowered viscosity and increased coalescence within the aqueous component-treated emulsion;

(3) enhanced gas liberation from the aqueous component-treated emulsion;

(4) reduced equipment fouling (e.g., heat exchanger fouling);

(5) enhanced chemical processing aid distribution within the aqueous component-treated emulsion (e.g., diluent distribution);

(6) enhanced separation in downstream processing (e.g., reduction in bottleneck, increase in processing capacity);

(7) adding stability to a continuous process by ensuring consistent fluid properties (i.e., viscosity) of the emulsion into the facility, reducing the probability of pressure fluctuations causing process upsets or a combination thereof;

(8) improved heat transfer due to decreased bulk emulsion viscosity, reduced occurrences of viscous fouling on heat exchangers;

(9) the process and system of the present invention may be used alone or in conjunction with other emulsion breaking strategies such as but not limited to, diluent addition or demulsification chemical injection;

(10) enhanced separation, particularly of complex tight emulsions (e.g, emulsions comprising water, heavy oil (e.g., bitumen), organic solids, clays (e.g., reduced rag layer formation);

(11) optimization tailored to the particular hydrocarbon-comprising emulsion characteristics (e.g., multiple aqueous component addition stages or multiple aqueous component addition and static mixing stages).

(12) enhanced performance of separation, particularly when heavier diluent (synthetic crude for example) is being used in the process.

The examples below describe further embodiments of the invention.

EXAMPLES

Figure 13:
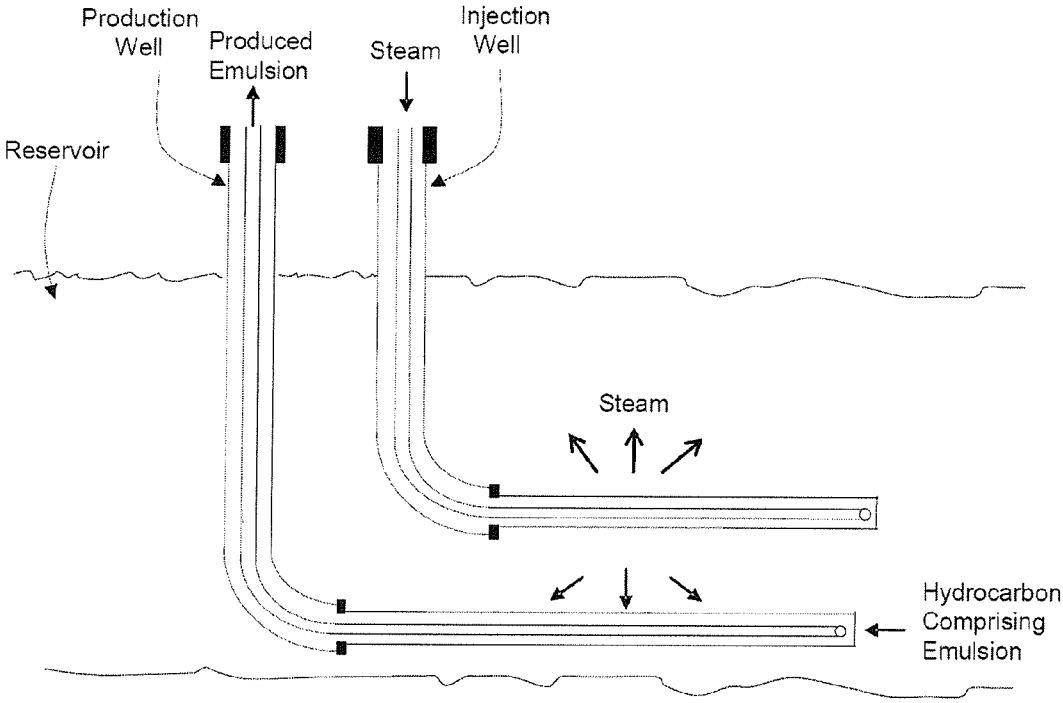
FIG. 13 illustrates a schematic diagram of a Steam Assisted Gravity Drainage (SAGD) process and production of the hydrocarbon comprising emulsion according to an embodiment.

The examples relate to treating an emulsion derived from SAGD. According to one embodiment, by way of example only, the hydrocarbon may be a hydrocarbon derived from a reservoir of bituminous sands. Referring to FIG. 13, there is shown a schematic example of an in situ thermal recovery process such as Steam Assisted Gravity Drainage (SAGD) from which the hydrocarbon-comprising emulsion may be derived. A typical SAGD process involves softening of the bitumen in a region in the reservoir to generate the hydrocarbon-comprising emulsion. The softening of the bitumen involves injecting steam through an injection well into the region to create a steam chamber. In various embodiments, softening the bitumen may further involve injecting a solvent (not shown) alone or in combination with other chemical agents such as surfactants (not shown) into the region to reduce the viscosity of the bitumen. The hydrocarbon-comprising emulsion is drained from the region into a production well below the region for recovery of the hydrocarbon. Water (steam) injected during the SAGD process and interstitial water facilitate the formation of the hydrocarbon-comprising emulsion. Because of the heterogeneous nature of the reservoir and the properties of the hydrocarbon recovered during the process (e.g., bitumen), in various embodiments, the hydrocarbon-comprising emulsion is chemically complex, heterogeneous, and comprises a number of other species (e.g., gas, surfactants, organic and inorganic species, fines), which can stabilize the hydrocarbon-comprising emulsion making it difficult to break in downstream processing.

Figure 14:
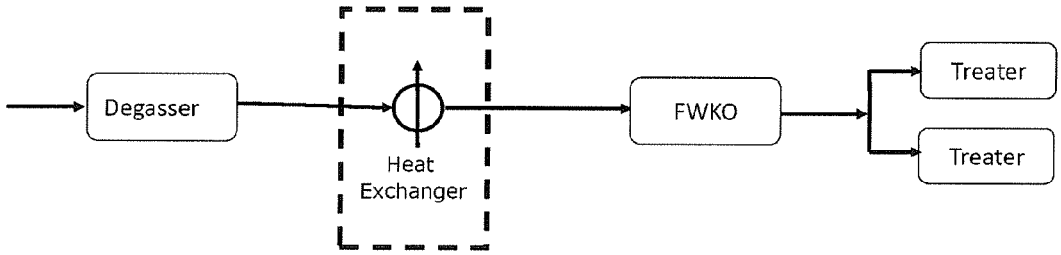
FIG. 14 illustrates a schematic diagram of a process circuit for treating the hydrocarbon-comprising emulsion according to prior art.

An example of a processing circuit which may be used in selected embodiments for treating the hydrocarbon-comprising emulsion is shown FIG. 14. This embodiment relates to treating the hydrocarbon-comprising emulsion derived from SAGD.

As is shown in FIG. 14, in one process configuration, the hydrocarbon-comprising emulsion enters the processing circuit first through an inlet degasser, and then passes through a heat exchanger (e.g., an emulsion/boiler feed water heat exchanger). Upstream of the degasser, the hydrocarbon-comprising emulsion is contacted with the aqueous component to form the aqueous component-treated emulsion having increased water cut as compared to the water cut of the hydrocarbon-comprising emulsion. The contacting of the aqueous component with the hydrocarbon-comprising emulsion is performed in this embodiment in a region generally adjacent the degasser so as to reduce the potential for the formation of a stratified flow. In the degasser, the entrained gases are removed and the emulsion is then directed to the heat exchanger for cooling. It has been observed that the hydrocarbon-comprising emulsion entering the inlet degasser is a heterogeneous complex emulsion (e.g., water-oil-water emulsion) which varies in water cut during its production from the SAGD operations. One of the problems that was identified with processing the hydrocarbon-comprising emulsion without treatment with the aqueous component related to the exchanger experiencing a higher than normal pressure drop (e.g., about 300 kPa vs. about 100 kPa), which is undesirable because it consumes available hydraulic capacity and contributes to plant operating difficulties. It was observed that the high pressure drop across the exchangers appears to occur due to the inlet hydrocarbon-comprising emulsion periodically crossing this inversion point. It was observed that as a result of increase in viscosity of the hydrocarbon-comprising emulsion, fouling of the heat exchanger occurred which resulted in reduced flow area and thus increased pressure drop and reduced heat transfer due to fouling.

Figure 2:
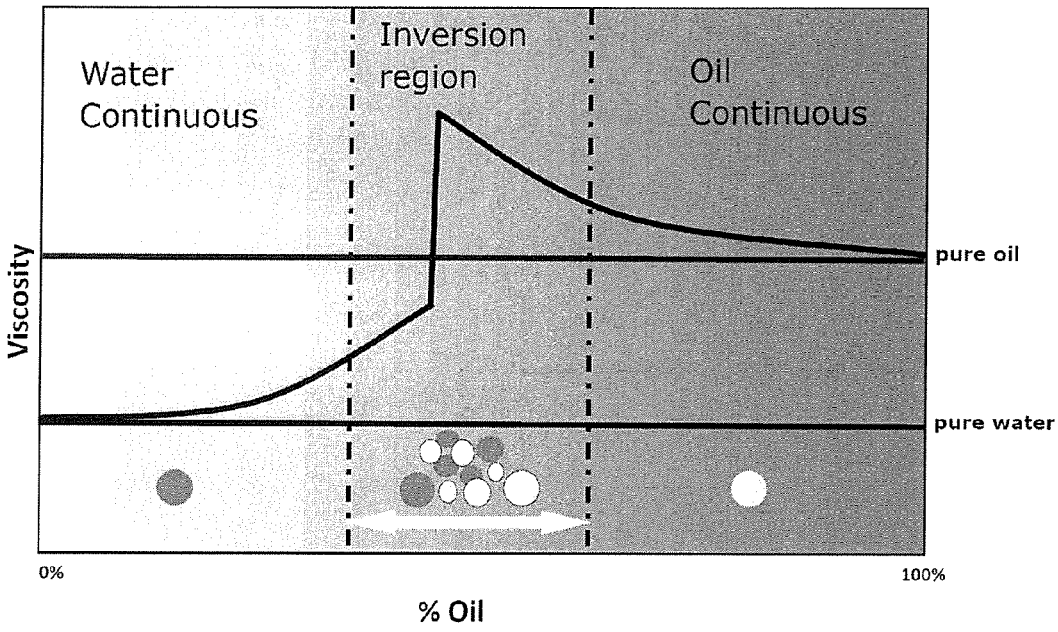
FIG. 2 illustrates emulsion viscosity as a function of water content, and the inversion point or region of the emulsion.
Figure 15:
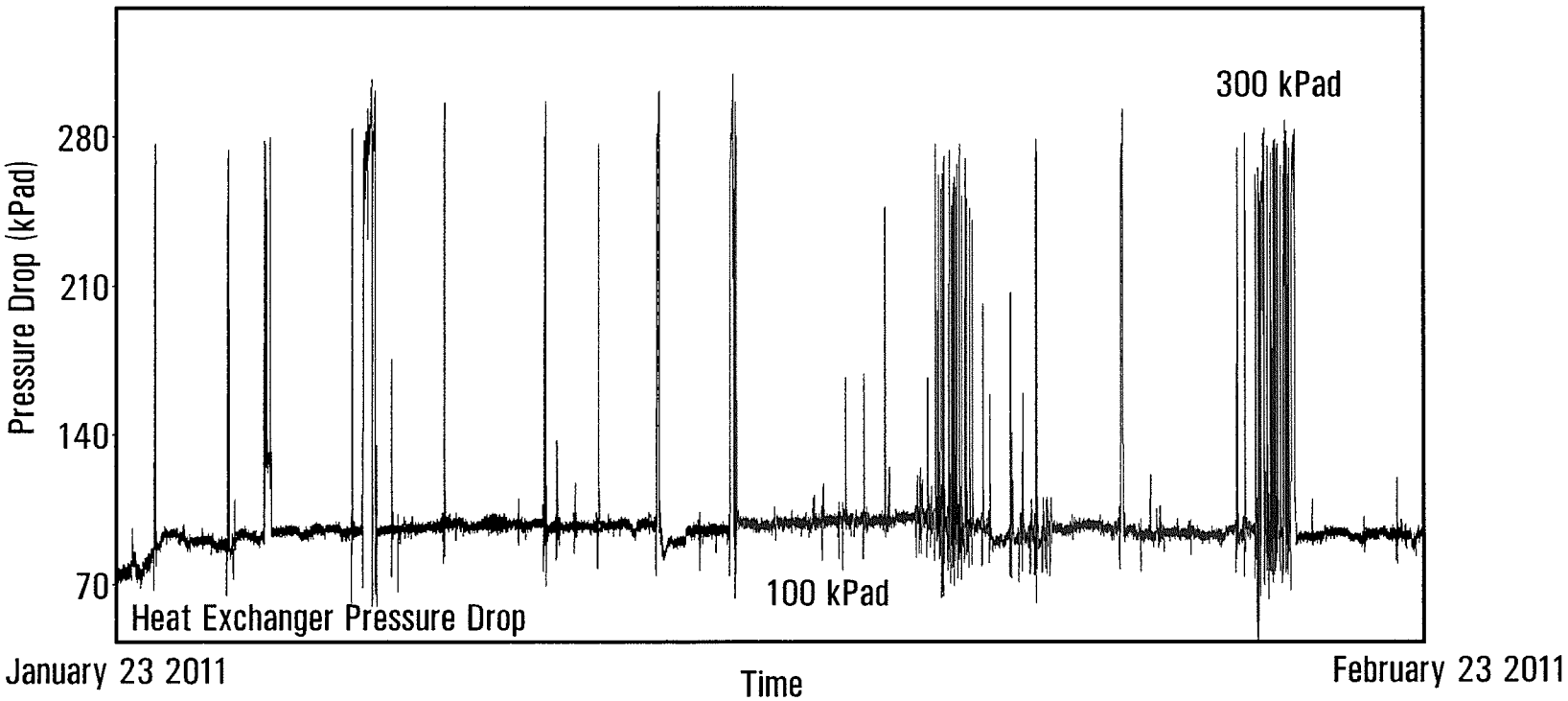
FIG. 15 illustrates data relating to increases in pressure drop across the heat exchangers.
Figure 16:
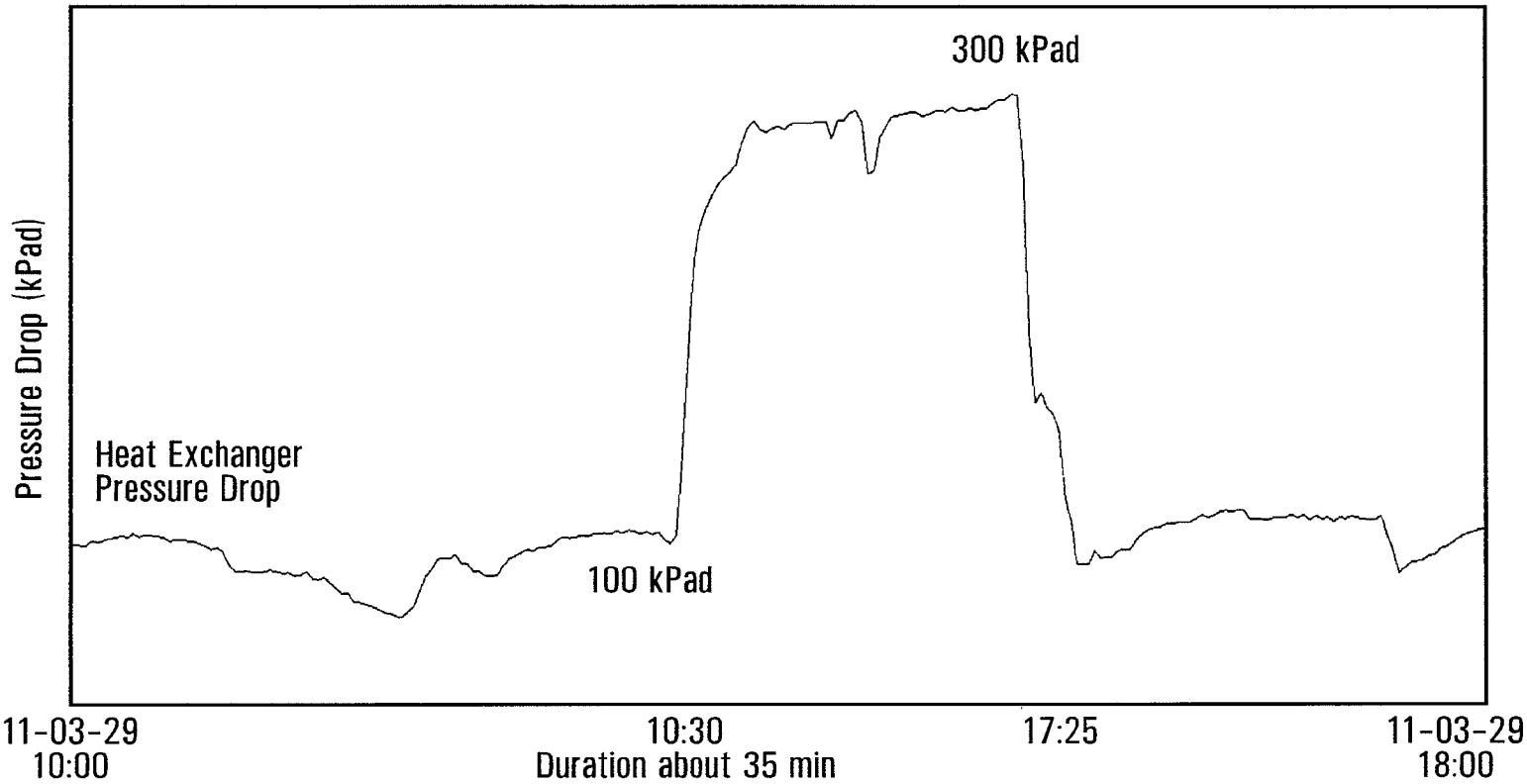
FIG. 16 illustrates data relating to a typical elevated pressure drop event including the duration and magnitude of the event.

Sampling of the emulsion water cut and a comparison of the water cut data against the pressure drop across the heat exchangers indicated that high pressure drop events occurred in the heat exchangers when the water cut was low (for example, an average of about 0.56 (i.e., 56%) as compared to an average of about 0.64 (i.e., 64%) for low pressure drop). FIG. 15 illustrates for example random increases in pressure drop across the heat exchanger(s). FIG. 16 illustrates a typical elevated pressure drop event. It was observed that the duration and magnitude of elevated pressure drop events varied but tended to be associated with downstream treating issues such as for example loss of clean water phase level in FWKOs, offspec water, wet emulsion being sent to treaters. The hydrocarbon-comprising emulsion produced from SAGD varies in properties, and as the relative quantity of the two main emulsion constituents (i.e. oil and water) varies, the hydrocarbon-comprising emulsion can undergo an inversion in which the liquid continuous phase switches from one constituent to the other; i.e., a switch from oil being the continuous phase to water being the continuous phase, or visa versa (FIG. 2). Generally at this inversion point, there is a significant increase in the viscosity of the emulsion. Several factors were found to influence the emulsion viscosity and stability including: volume fraction of oil and water phases, viscosity ratio of oil and water phases, temperature, interfacial tension, vapor loading, shear history (e.g., average droplet size, droplet size distribution), pH, solids content and size, or a combination thereof. The treatment of the hydrocarbon-comprising emulsion with the aqueous component upstream of the degasser, the heat exchanger or both was found to reduce or eliminate the problem of high pressure drops in the heat exchangers. Treatment of the hydrocarbon-comprising emulsion with the aqueous component according to the various embodiments upstream of the heat exchangers (i.e., manipulation of the location at which the high viscosity event takes place) resulted in a reduction of the fouling of the heat exchanger due to a decreased viscosity of the aqueous component-treated emulsion.

As is shown in FIG. 14, following cooling in the heat exchanger, the cooled aqueous component-treated emulsion is then directed to a separator (e.g., free water knockout units, FWKOs A-D). When the aqueous component-treated emulsion exits the heat exchanger it remains an emulsion without substantial phase separation. Separation takes place in the FWKO units. If a portion of the aqueous component-treated emulsion does not separate, further separation is achieved in the treater units (e.g., treaters A-H). In the absence of the treatment of the hydrocarbon-comprising emulsion with the aqueous component at the selected location to cause the high viscosity event to occur at another selected location, it was also observed that treating in general was negatively impacted, and in particular resulted in increased gas retention to downstream treating vessels (e.g., foamy emulsion created), reduced velocity of separation in FWKO and treaters, control instability or a combination thereof. The experimental study involved various aspects including:

(1) forcing the emulsion towards the emulsion inversion point (i.e., the high viscosity event) in a water deficient regime by manipulating field production (e.g., SAGD field production);
(2) artificially increasing the inlet water cut of the emulsion by, for example, recycling produced water from free water knockout units (FWKO) to the inlet degasser thereby forcing the inlet emulsion feed beyond the inversion point (i.e., the high viscosity event) and into the water continuous regime;
(3) artificially increasing the inlet water in (2), by supplementing with a small quantity of boiler feed water;
(4) artificially increasing the water cut of the fluid feeding the FWKO by recycling water from it's own water dump;
(5) monitoring process conditions and collecting data to further investigate the pressure drop problems in the heat exchangers and associated treating problems.

The emulsion samples were obtained from the outlet of the inlet degasser to establish the starting point for the tests and to determine which high water producing wells in the field needed to be manipulated and to establish a base line starting point for the test before water addition.

Samples were gathered from the outlet streams of FWKO units (e.g., two trains to minimize the quantity of samples that must be handled to give a representative snapshot of the entire oil treating train).

Once the starting point water cut of the inlet emulsion is established, the wells which are high water producers will have flow rates reduced until the desired target inlet water cut is achieved or the maximum allowable production cuts have been reached. The manipulation of the production wells is only one aspect which may be used to modulate the water cut in particular embodiments. The water cut of the emulsion may be modulated without manipulation of the output of the production wells.

In another experiment, water cut of the hydrocarbon-comprising emulsion derived from in situ thermal processes such as for example SAGD was modulated using addition of water, and in particular addition of water from for example one or both of the following sources:

(1) produced water (PW) recycled from FWKO via a desand jet pump directly into the inlet degasser. The water pressure and flow were controlled.
(2) boiler feed water addition (BFW) (e.g., into the inlet produced emulsion pipe).

In some embodiments, the more desirable option may be to add water using the produced water as the temperature is closer to that of the inlet produced emulsion. However, if a large enough volume of produced water to increase the water cut above the inversion point or to cause an observable change in the performance of the downstream exchangers or treating trains cannot be obtained, supplemental boiler feed water can be added.

Figure 17:
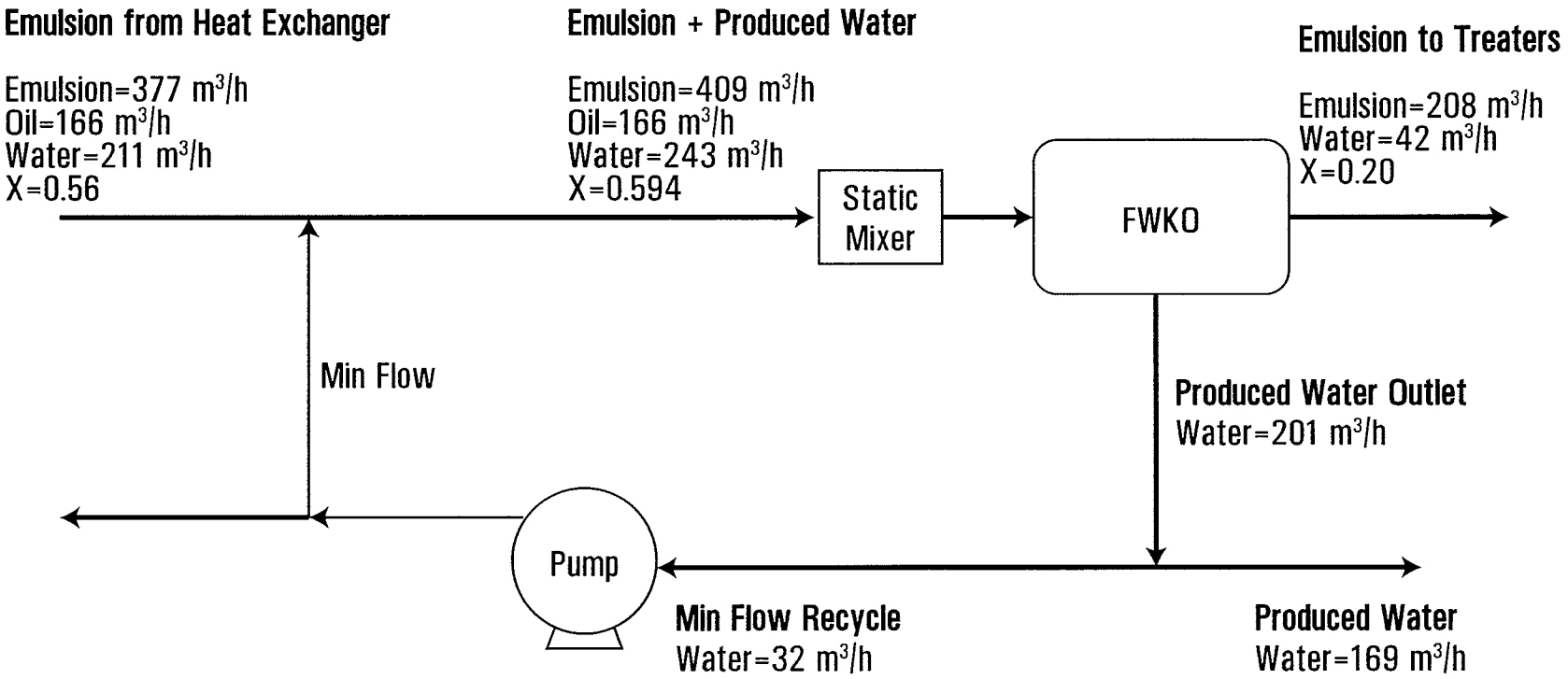
FIG. 17 illustrates recycle flow rates obtained in a FWKO trial.

Water (aqueous component) may be added at various addition points. For example, water could added using a recycle line from the pump back to the inlet emulsion of the FWKO as is shown in FIG. 17. This would artificially increase the water cut in the emulsion to the FWKO "B" train from about 0.56 to about 0.63, considering that the maximum pump capacity in this experiment of about 28 $m^3/h$ was recycled. The initial results obtained may be assessed as to the impact of injected water into the degasser to determine whether to continue with the produced water injections through the desand system or divert water to the inlet of a FWKO via the minimum flow recycle line.

As this would only affect the one train, samples can be taken from the FWKO and treaters in order to assess if the increase in water cut resulted in decreased treating difficulties. The water dumps of the treaters and FWKOs can be monitored to assess water quality, and the emulsion outlets of the FWKOs will be monitored for downstream operations.

If water is injected prior to the emulsion entering FWKO, the effect of an increase in water cut on the heat exchangers will not be observed, as the injection point is downstream of the exchangers. However, this will allow a comparison between the FWKO train with the addition of an aqueous component and the other trains to observe if increasing the water cut resolved treating issues in the FWKO and treater vessels for the particular emulsion studied.

Baseline data collection relating to a water cut for a particular emulsion to be treated may be obtained by taking samples over a period of time at a selected frequency prior to treatment. The samples may be taken for example from the outlet of the degasser, the water dumps of the FWKOs and treaters, and the emulsion outlets of the FWKOs. An alternative to taking samples from the water dumps of FWKOs and treaters is to take samples at the inlet of the skim tanks to determine overall change in water quality, rather than from each individual train.

The emulsion samples were analyzed for water cut, and the water cut of the emulsion from the degasser was used as data for trending produced emulsion water cut against high pressure drop instances. The FWKO outlet emulsion water cut provided an indication whether the addition of produced water aided in hydrocarbon/water separation in the FWKOs, reducing the amount of water in the emulsion fed into the treaters or a combination thereof. The water dumps were sampled to assess whether the addition of produced water increased the water quality. These samples were measured against historical data to measure water quality improvement. Measurement of the taps of FWKOB, treater C and treater D for example can be used to determine the number of taps of water, as well as the water cut in the lowest oil tap, which can provide an indication of a tightening of the rag layer. For example, as the rag layer tightens, less water will be mixed into the oil at the interface, and therefore the water level in the vessel should be higher.

Prior to the start of monitoring of the emulsion, production may be shifted more heavily to high oil producing wells and limited in high water producing wells in order to obtain produced emulsion with a low water cut coming into the plant. The effects of water addition to the emulsion will be more obvious if the trial is carried out while production problems are occurring.

Examples of the advantages offered by monitoring and treating the emulsion related to for example increased production, reduced operating costs, safety, environmental advantages or a combination thereof. The high pressure drops observed across the heat exchangers result in a process bottleneck and therefore increased inlet degasser operating pressure and decreased operating pressures of the FWKOs and treaters. Treating the hydrocarbon-comprising emulsion with the aqueous component according to the various embodiments described facilitates a reduction in the occurrence of heat exchanger high pressure excursions therefore reducing treating difficulties associated with increased pressure drops across the heat exchangers, increasing process stability thereby allowing future production increases, increasing quality of all streams leaving the oil treating trains or a combination thereof.

Figure 18:
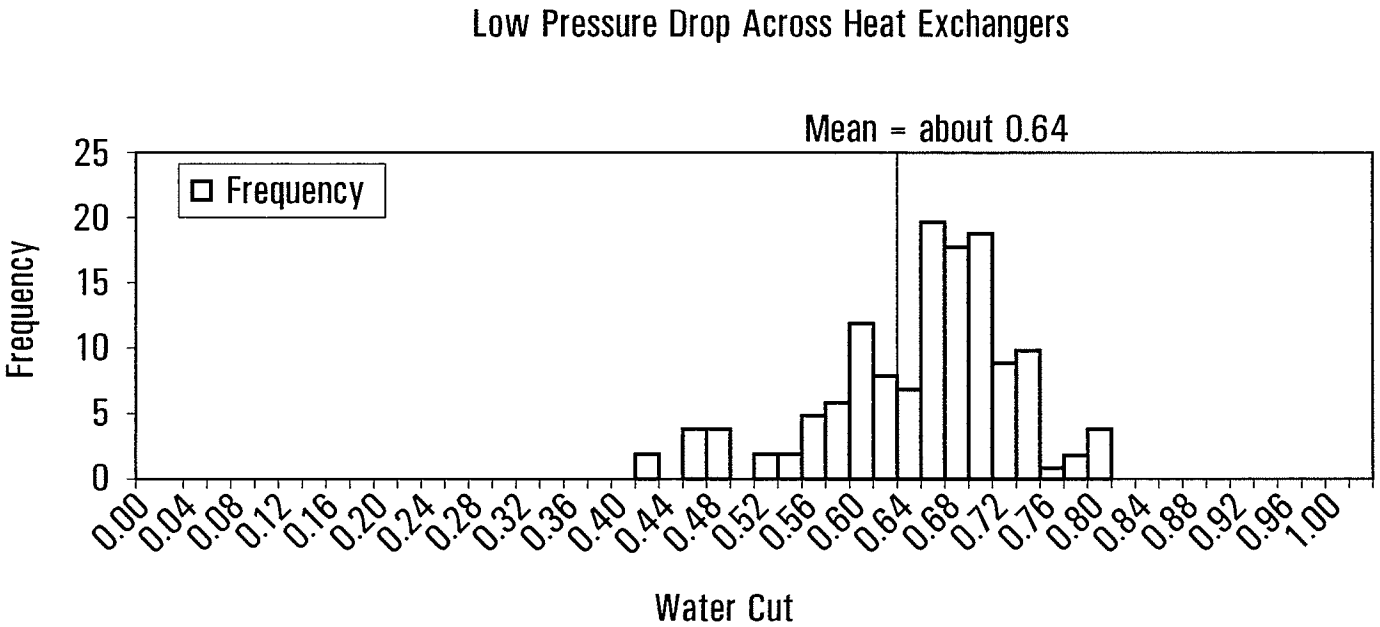
FIG. 18 illustrates a heat exchanger low pressure drop histogram.
Figure 19:
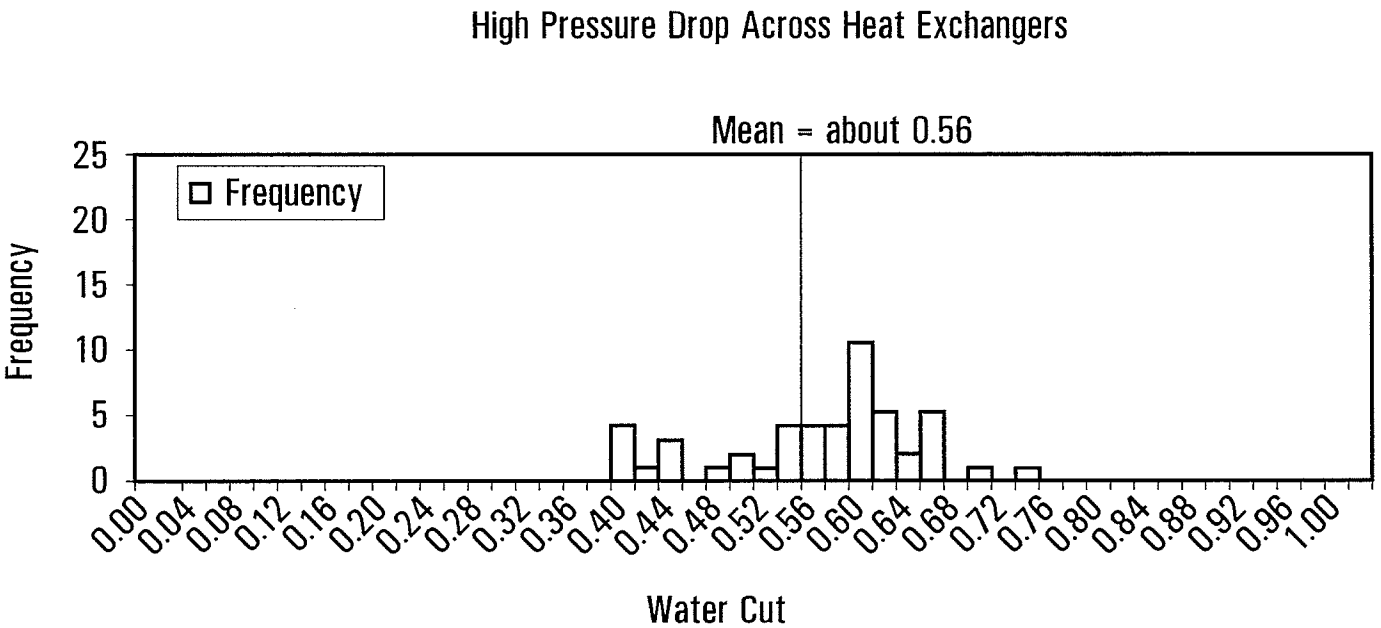
FIG. 19 illustrates a heat exchanger high pressure drop histogram.

FIGS. 18 and 19 illustrate a correlation between low water cut and increased instances of high pressure drop. FIG. 18 shows a data histogram for the instances of low pressure drop observed across the heat exchangers. The x-axis is water cut and the y-axis is the number of observed samples at given water cut. It can be seen that the mean for this data set is about 0.64. FIG. 19 shows a data histogram for instances of high pressure drop observed across the heat exchangers. The mean for this data set is about 0.56.

Figure 20:
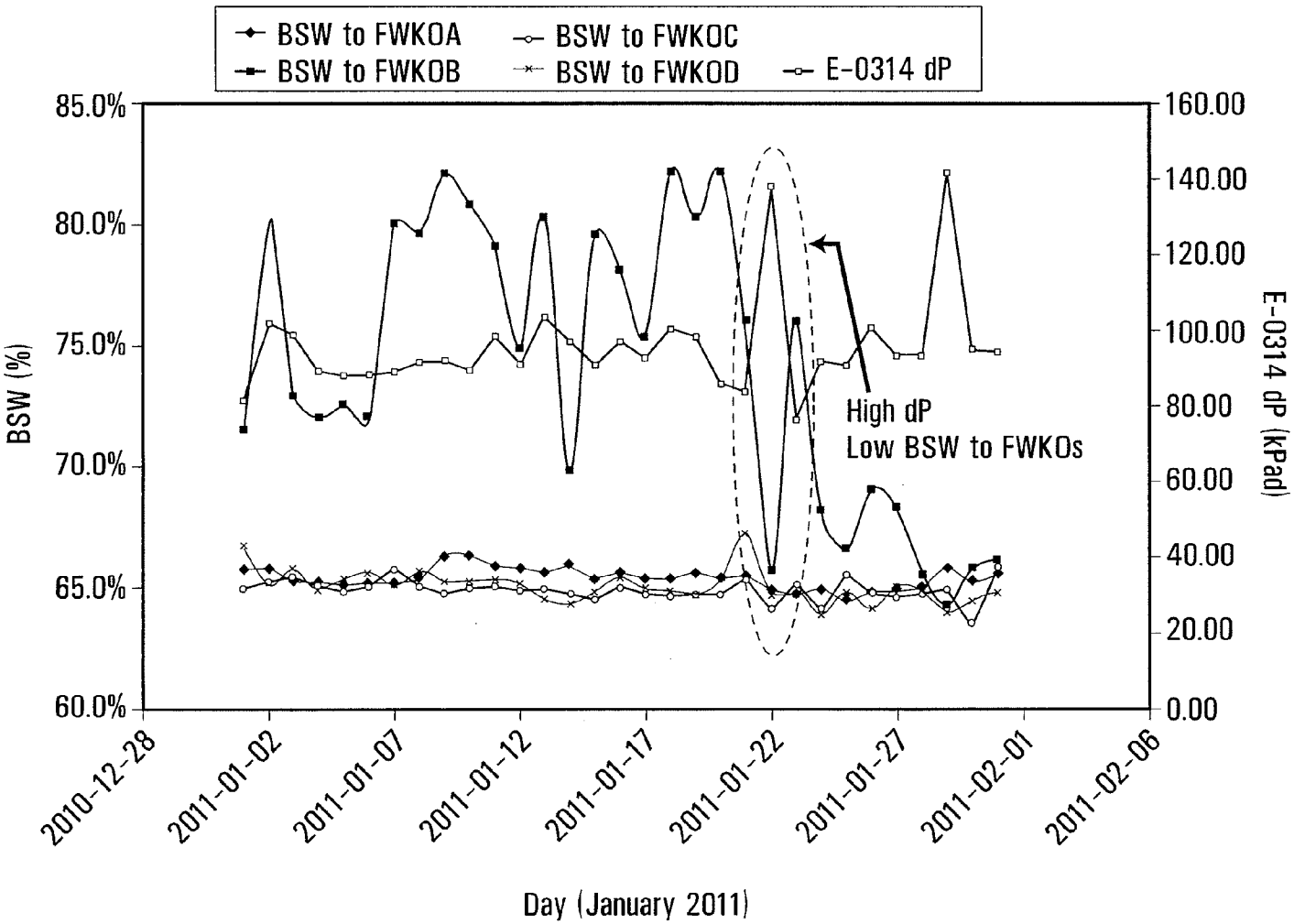
FIG. 20 illustrates data relating to calculated BSW to FWKOs and heat exchanger pressure drop.
Figure 21:
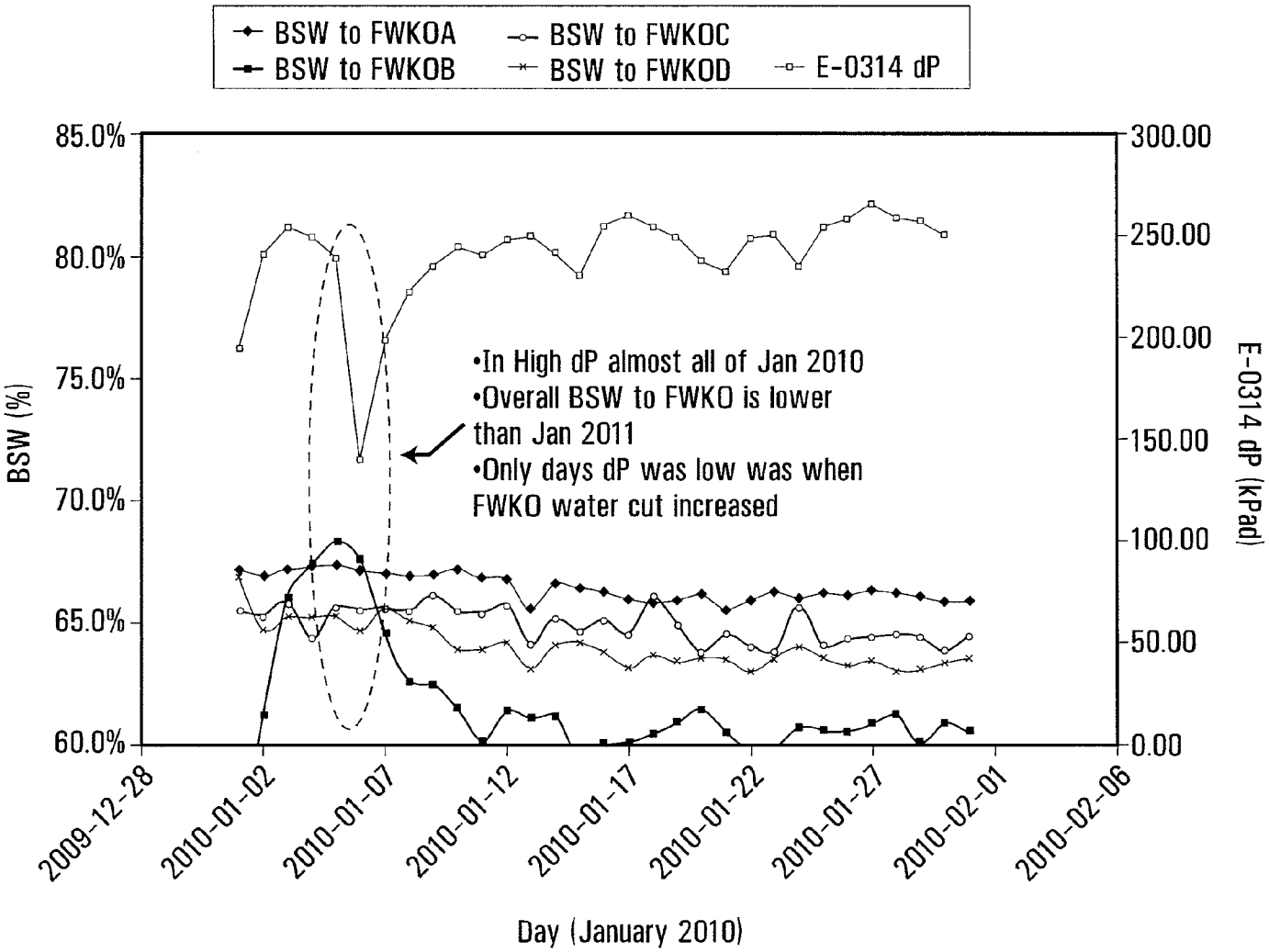
FIG. 21 illustrates further data relating to calculated BSW to FWKOs and heat exchanger pressure drop.

FIG. 20 and FIG. 21 illustrate calculated basic sediment and water (BSW) to FWKOs and heat exchanger pressure drop.

FIG. 2 illustrates a graph of viscosity vs. oil cut curve depicting a spike in viscosity at the emulsion inversion point or region.

Figure 22:
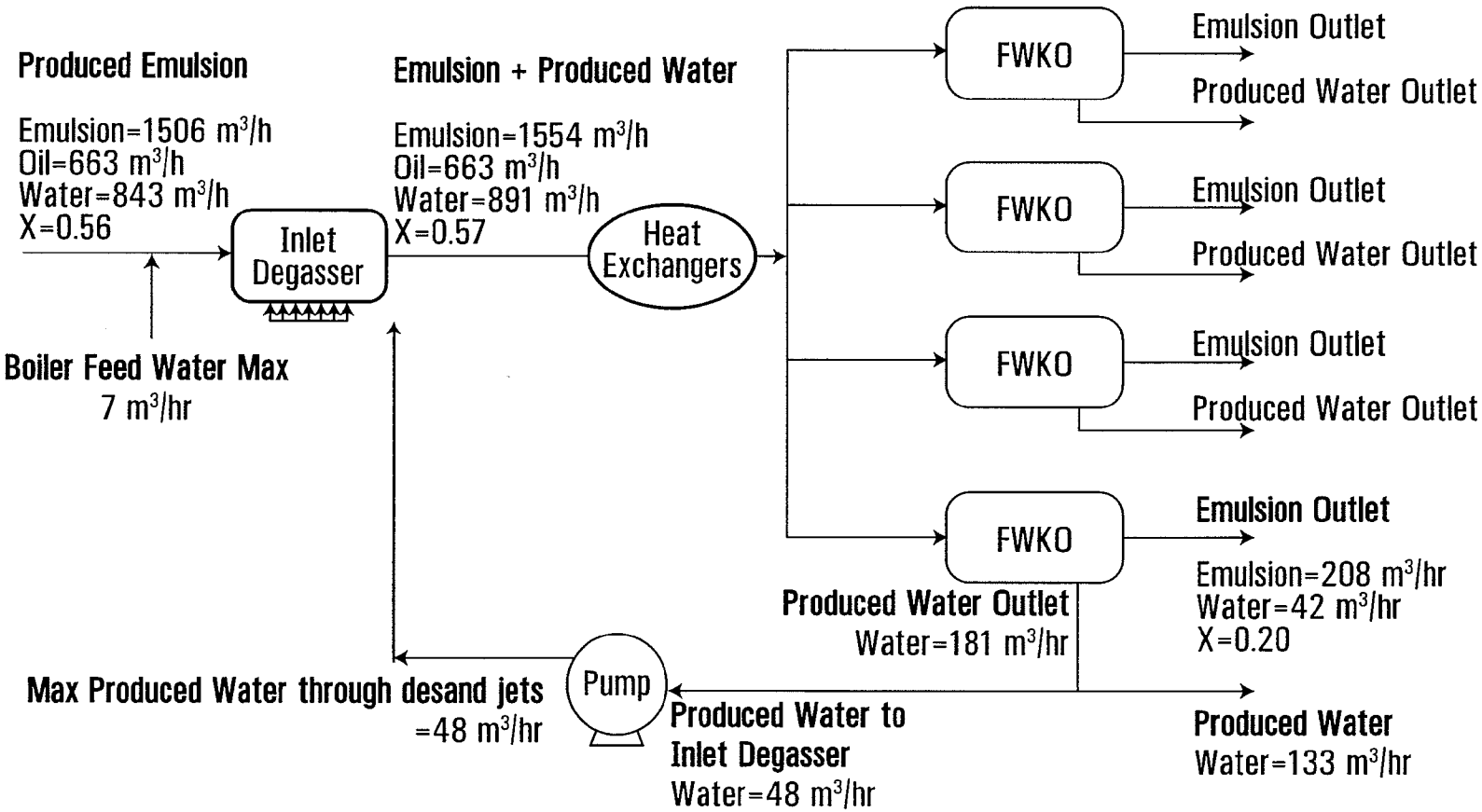
FIG. 22 illustrates recycle flow rates obtained in the inlet degasser trial.

An experiment was conducted without manipulating the field production. The experimental set up is shown in FIG. 22. In this experiment, a limited amount of flow was available for recycle to the inlet degasser (e.g., maximum about 55 $m^3/h$ with produced water recycle and boiler feed water recycle), corresponding to an increase in water cut of only approximately 1%. Additionally, there was poor mixing as the produced water, which constituted about 47 $m^3/h$ of recycled water, was being injected through the downwards pointing desand jets of the inlet degasser. This promoted formation of a water layer at the bottom of the vessel and did not allow for the water to be mixed with the emulsion in order to increase overall water cut. Other factors that had a negative impact in this experiment were, for example, poor sampling points.

It was decided that due to the complications with obtaining representative results while recycling water to the degasser, the water recycle would be redirected to the inlet of the FWKO. The produced water was injected upstream of the static mixer, so sufficient mixing was obtained. The actual recycle flow rates that were obtained in this part of the experiment are outlined in the flow diagram in FIG. 17.

In this experiment, the aim of recycling water to the FWKO was to demonstrate the effects of water recycle on separation and treating. Based on Stokes' Law, decreasing the viscosity of the emulsion will increase separation velocity and allow for a greater degree of separation by the outlet end of the vessel. Increasing the water cut of the emulsion will ensure that the viscosity remains closer to that of pure water and will reduce the likelihood for emulsion inversion and the corresponding increase of viscosity.

$$v \approx \frac{D^2(\rho_d - \rho_e)g}{18\ \mu_e} \qquad \text{(Formula 1)}$$

where: v=velocity of droplet, D=droplet diameter, $\rho_d$ and $\rho_e$=density of droplet and emulsion, respectively, g=gravity, and $\mu_e$ is the viscosity of the emulsion.

Figure 23:
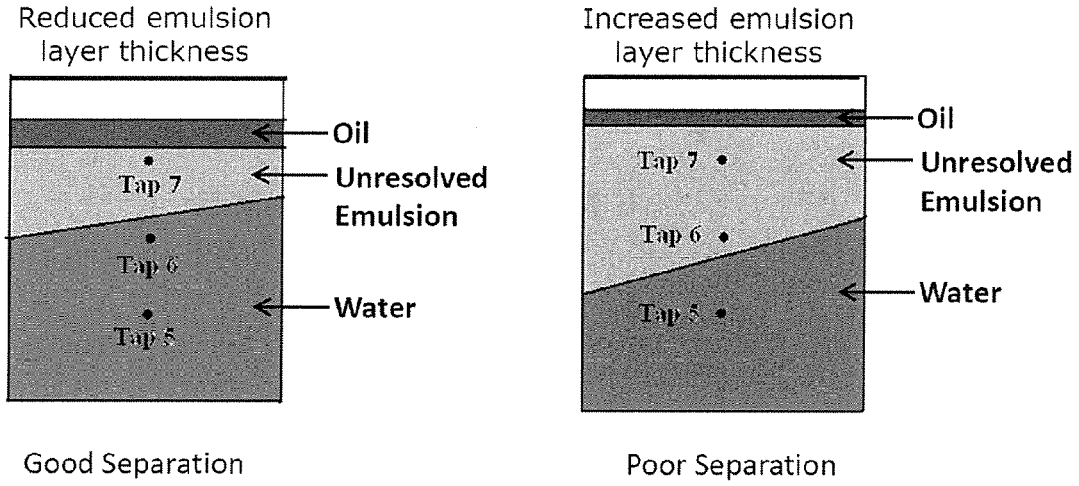
FIG. 23 illustrates a schematic depicting good vs. poor resolution of emulsions.
Figure 24:
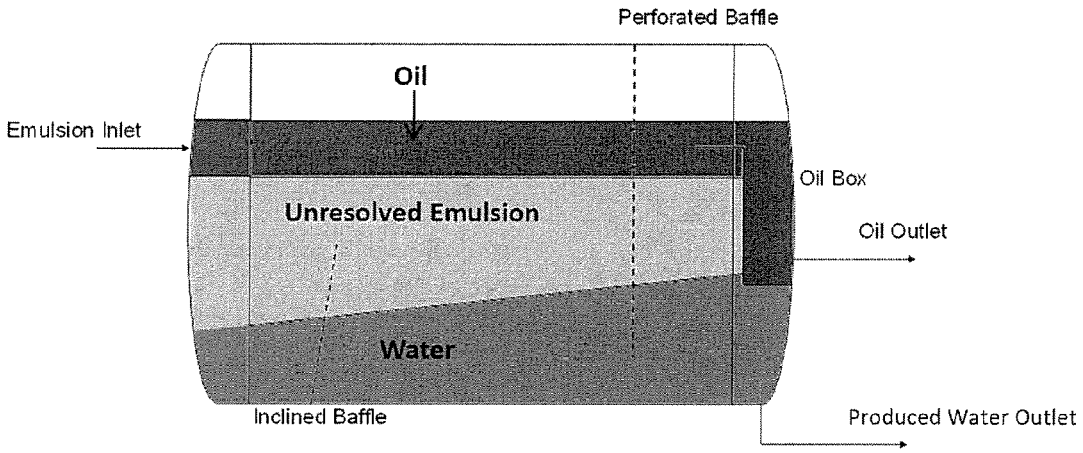
FIG. 24 illustrates a schematic of a larger unresolved emulsion layer indicative of poor separation.
Figure 25:
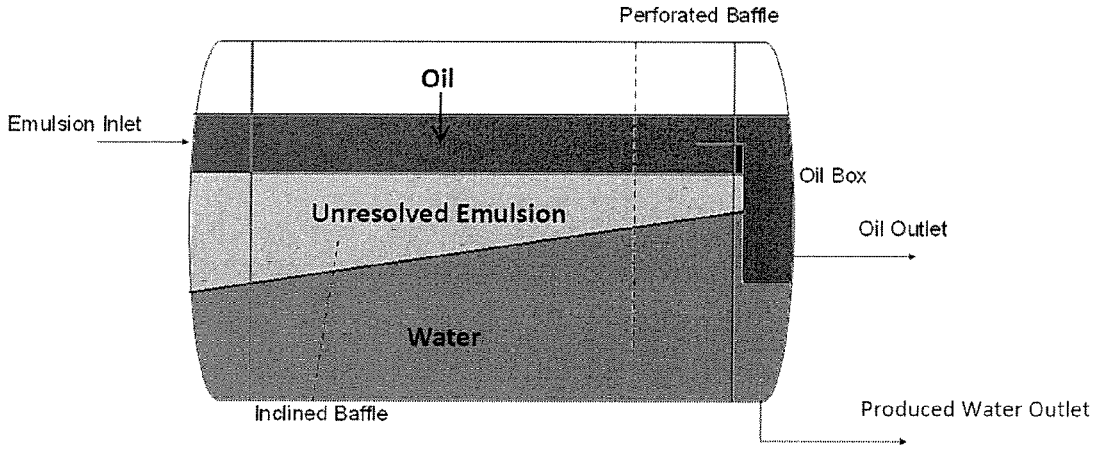
FIG. 25 illustrates a schematic of a smaller unresolved emulsion layer indicative of good separation.

FIG. 23 illustrates schematic diagrams showing good resolution and poor resolution respectively. FIG. 24 shows unresolved emulsion layer indicative of poor separation, and FIG. 25 shows smaller unresolved emulsion layer indicative of good separation.

During elevated pressure drop events under regular process conditions, the separation obtained in the vessel declines and as a result there is a greater oil & grease (O&G) content in the produced water dump, leading to off spec water, and a greater carryover of water from the FWKOs to the treaters, which can result in off spec oil. With the water recycle turned on, it was observed that better resolution was obtained in the vessel, supporting that produced water recycle enhances separation. Additionally, during elevated pressure drop events, while the unresolved emulsion layer still expanded to an extent, it was more resolved than during an elevated pressure drop event with no produced water recycle. The results are illustrated in FIG. 26 and FIG. 27 showing data in connection with produced water recycle to the FWKO, and further in FIG. 28 showing the effect of water cut on pressure drop and separation.

Figure 26:
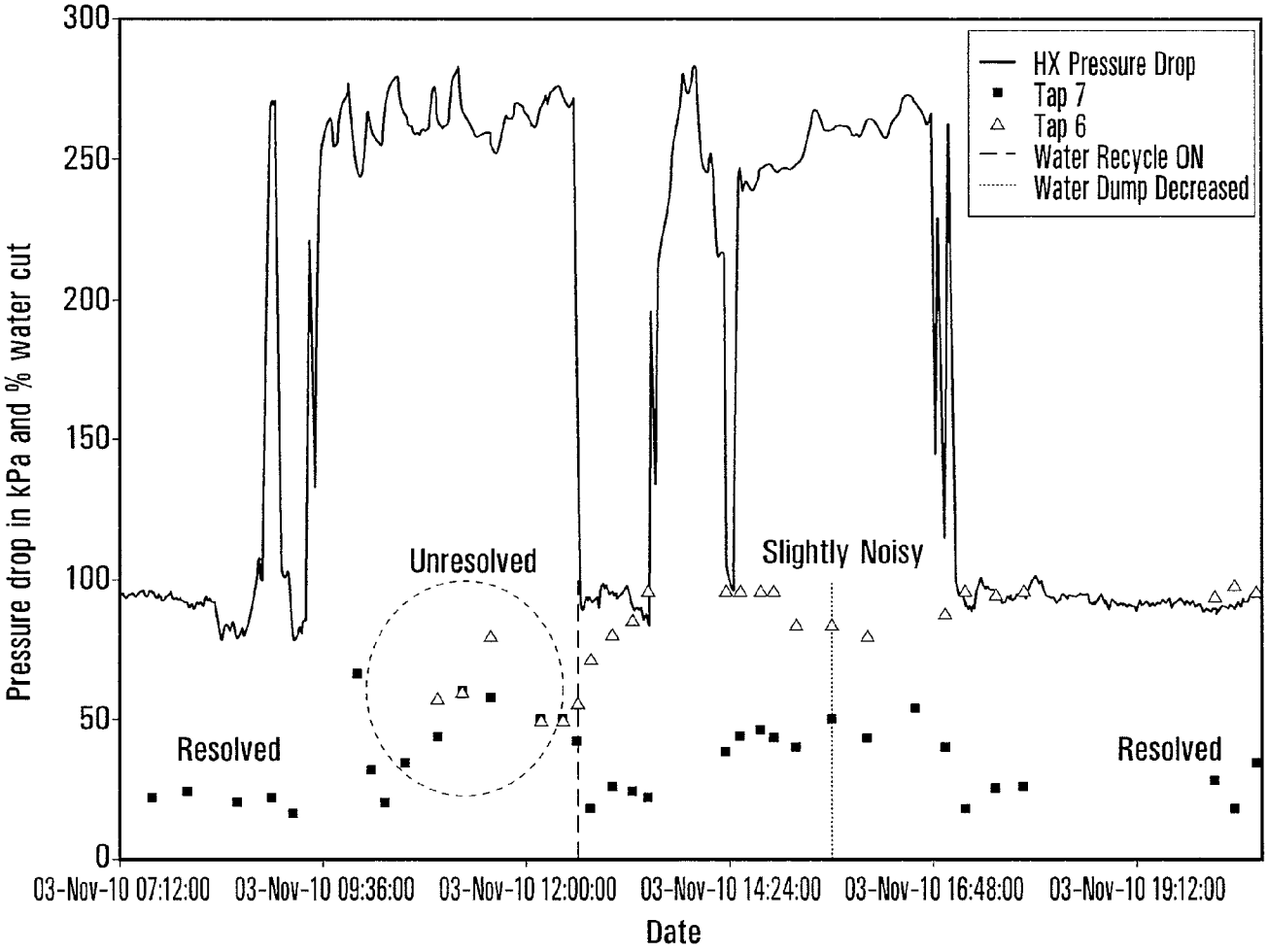
FIG. 26 illustrates data relating to produced water recycle to the FWKO.

The circled section in FIG. 26 shows how unresolved the emulsion was during high pressure drop occurrences with no water recycle on, as Tap 6 and Tap 7 had approximately the same water cut, indicating that the unresolved layer was expanded. This figure also illustrates that as the water recycle was turned on, there was an immediate effect on the resolution within the vessel. Tap 6 went to about 100% water, and the water content of Tap 7 decreased to below about 50%. Compared to the second elevated pressure drop event depicted in FIG. 26, where there is an elevated pressure drop across the heat exchangers with produced water recycle on, there is much better resolution, even though there is still an observed drop in water cut of Tap 6 indicating that more oil is present at this point and that separation has decreased slightly. When the elevated pressure drop breaks, good resolution is again observed.

Figure 27:
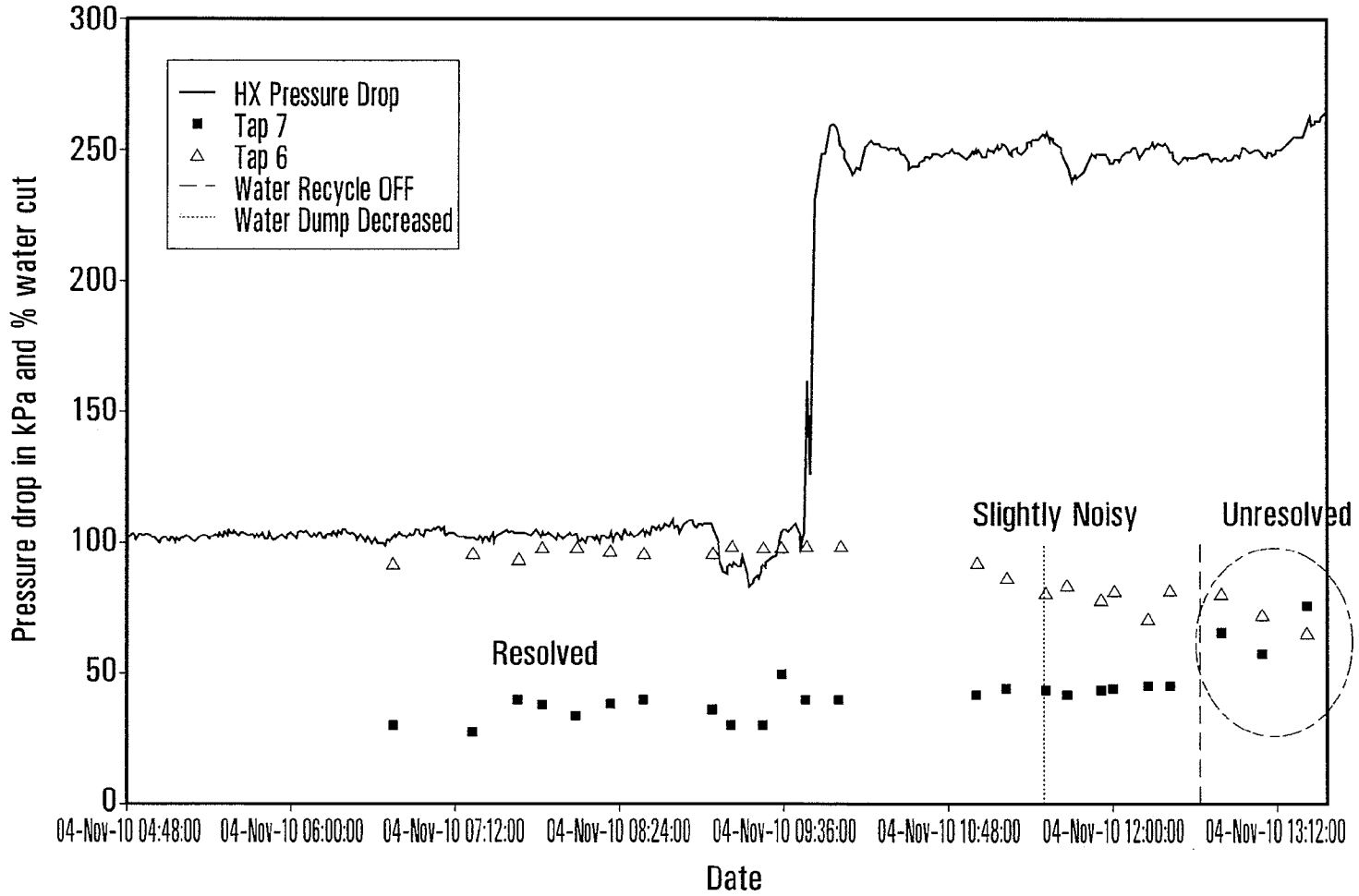
FIG. 27 illustrates further data relating to produced water recycle to the FWKO.

FIG. 27 illustrates that good resolution is being maintained with the water recycle on. There is a decrease in resolution as another elevated pressure drop event is occurring. At the point in which the produced water recycle is stopped, resolution immediately deteriorates and the unresolved layer expands, resulting in loss of resolution. After the water recycle was stopped, the clean water level moved from Tap 6 to Tap 4.

Figure 28:
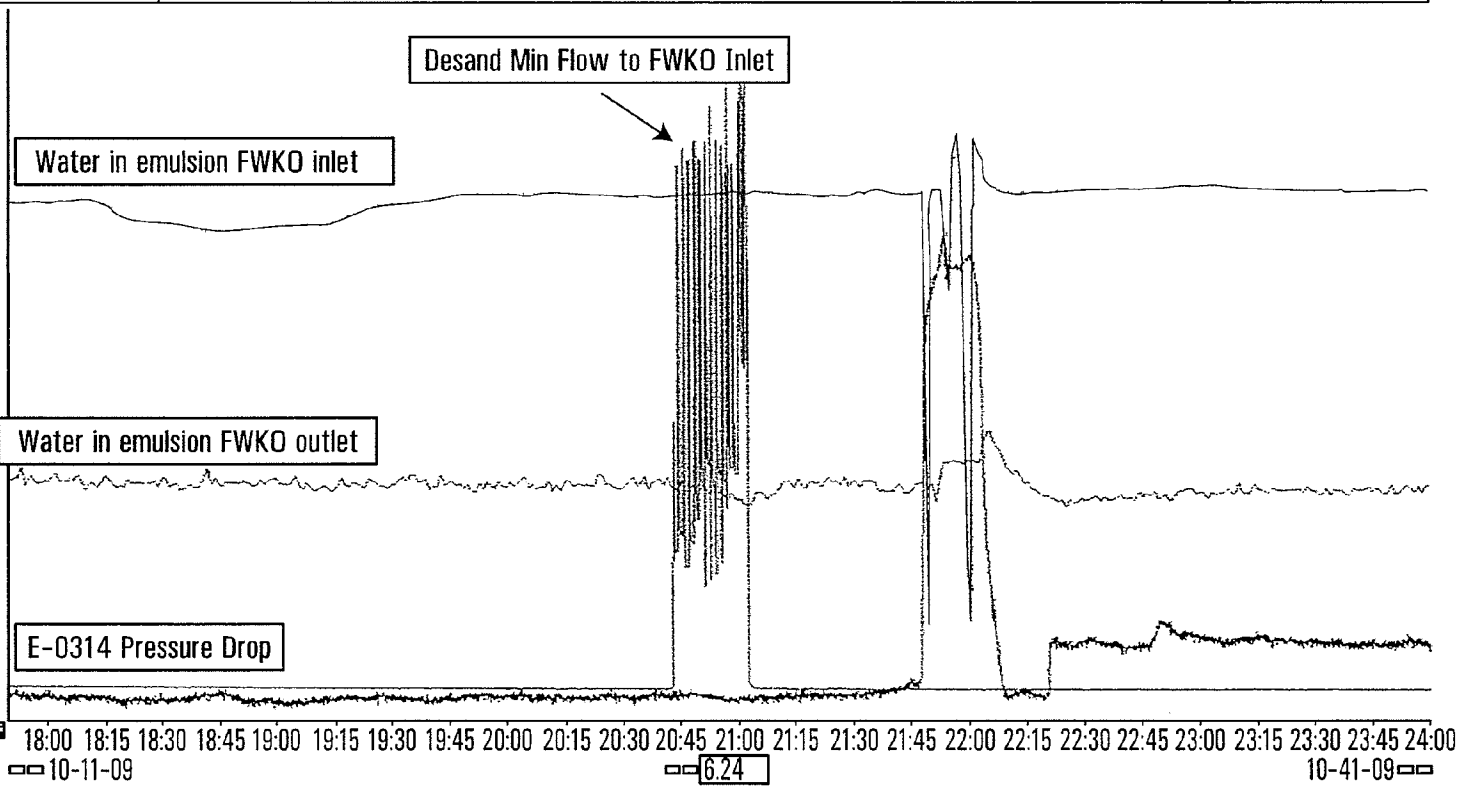
FIG. 28 illustrates data relating to effects of water cut on pressure drop and separation.

FIG. 28 illustrates the % of water in the FWKO inlet and outlet emulsion, as well as the heat exchanger pressure drop trend. From this data, the elevated pressure drop event is followed immediately by a drop in BS&W to the FWKO. As the BS&W meter is downstream of the heat exchangers, this correlates to an elevated pressure drop event at the time that the reduced water content emulsion was travelling through the heat exchangers. Additionally, the water cut of the emulsion out of the FWKO increased during the elevated pressure drop, indicating that separation is negatively impacted when there is a high pressure drop and as a result more water is present in the outlet emulsion.

The experiments conducted indicate that during low pressure drops across the heat exchangers, there is a clearly resolved emulsion layer, during high pressure drops across the heat exchangers, the emulsion layer becomes less resolved and expand, during high pressure drops across the heat exchangers with produced water addition, the emulsion layer becomes more resolved and the expanse over which it extends is reduced, and during high pressure drops across the heat exchangers with produced water addition stopped, the emulsion layer immediately thickens and the resolution decreases.

The benefits of water recycle to the FWKO were evident from the experiments with respect to enhanced (increased) separation of water and emulsion in the vessel. Additional benefits include:

(1) a reliable interface control—if unresolved emulsion layer thickness is reduced, an improved detection of the difference in fluid properties used by the specific level technology (e.g. density, dielectric constant, etc.) may be obtained and provide a more stable interface level output than when the unresolved emulsion layer is expansive. For example, when the two components are thoroughly mixed with a gradual transition to oil, the detection of differences in the fluid properties is difficult.

Figure 29:
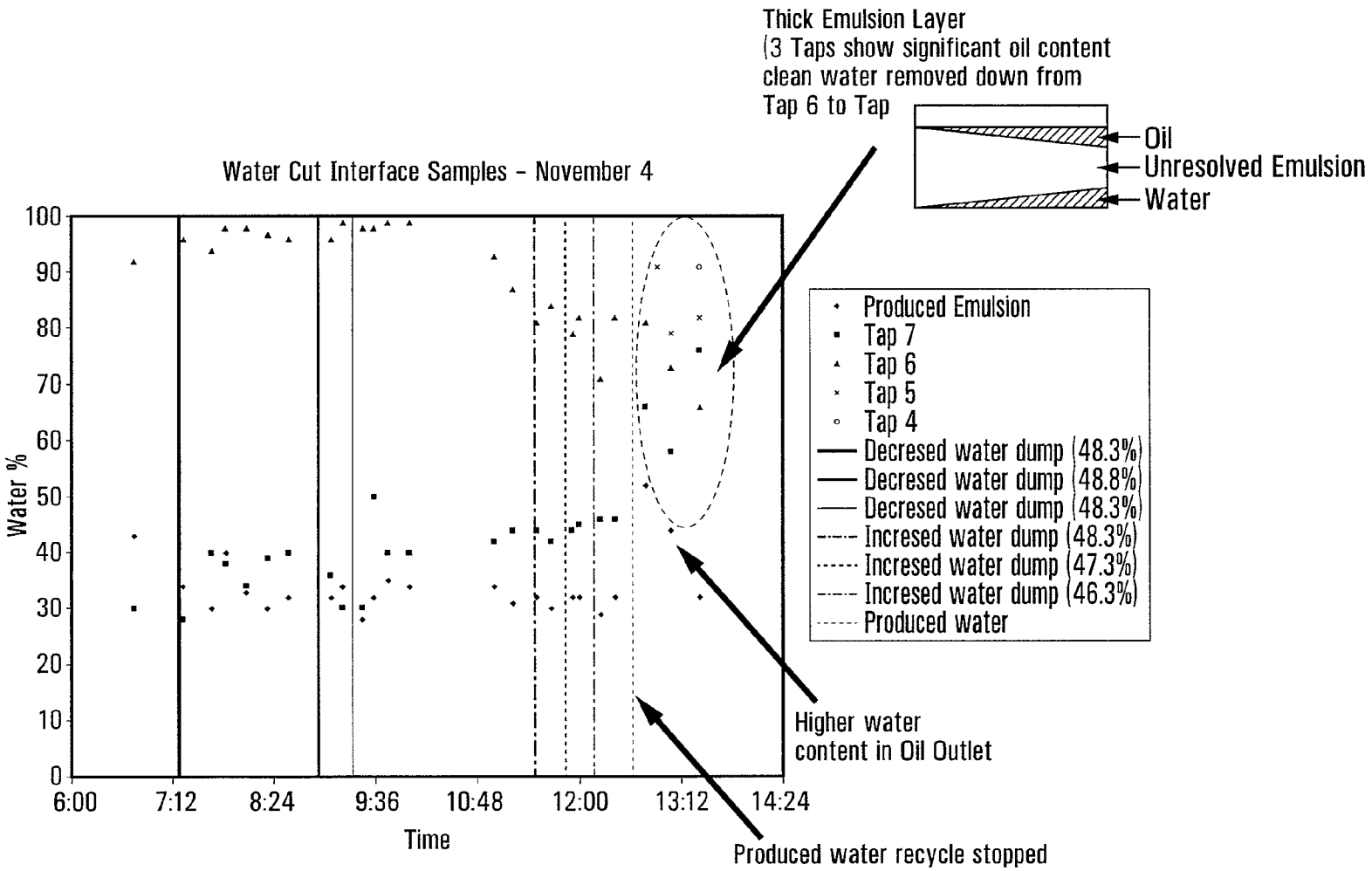
FIG. 29 illustrates increased separation achieved with the treatment of the hydrocarbon-comprising emulsion with the aqueous component (water recycle)

(2) increased treating capacity—better separation (e.g., FIG. 29) allows the ability to increase production rates and ensure that oil and water do not go off spec.

Figure 30:
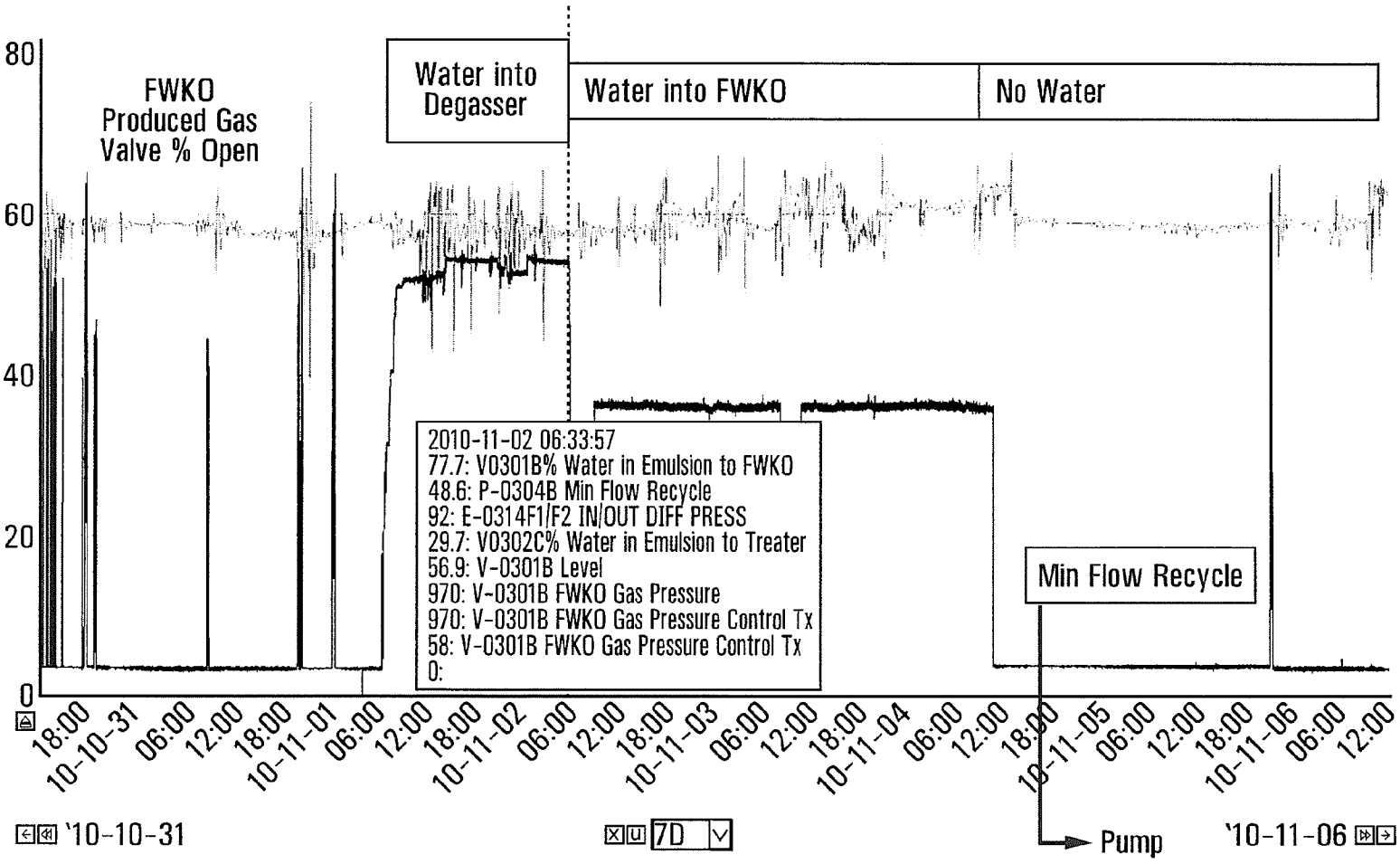
FIG. 30 illustrates increased gas removal achieved with the treatment of the hydrocarbon-comprising emulsion with the aqueous component (water recycle).

(3) improved gas removal in the FWKOs, treaters or both (e.g., FIG. 30)—gas is seen to carry through the inlet degasser to the downstream treating vessels during high pressure drop events. If the viscosity of the emulsion in these vessels is reduced, the gas will be better able to break out.

(4) cleaner water dumps—less oil lower in the vessel will ensure cleaner produced water (5) dryer oil to treaters—better separation means more water has moved to the bottom of the vessel and will be dumped as water rather than being carried through the emulsion to the treaters. The treaters were designed for about 10% to about 20% water in the inlet emulsion, but are currently receiving emulsion with a water cut between about 20% to about 40%.

(6) lower chemical consumption—currently, chemical rates are increased during high pressure drop events when there is poor separation, in order to aid in resolving the emulsion. If this can be done with water, as shown in the trial, chemical rates can be reduced, resulting in large cost savings.

(7) limited need for tap checkers—if auto interface control is implemented, there will be a reduced need for tap checkers.

Although specific embodiments of the invention have been described and illustrated, such embodiments should not be construed in a limiting sense. Various modifications of form, arrangement of components, steps, details and order of operations of the embodiments illustrated, as well as other embodiments of the invention, will be apparent to persons skilled in the art upon reference to this description. It is therefore contemplated that the appended claims will cover such modifications and embodiments as fall within the true scope of the invention. In the specification including the claims, numeric ranges are inclusive of the numbers defining the range. Citation of references herein shall not be construed as an admission that such references are prior art to the present invention.

The invention claimed is:

1. A process for enhanced separation of a hydrocarbon-comprising emulsion, the process comprising:

contacting the hydrocarbon-comprising emulsion with an aqueous component to form an aqueous component-treated emulsion upstream of a degasser; and dispersing a sufficient amount of the aqueous component within the hydrocarbon-comprising emulsion under low shear conditions to increase a water cut and reduce a viscosity of the aqueous component-treated emulsion as compared to a water cut and a viscosity of the hydrocarbon-comprising emulsion, to destabilize the hydrocarbon-comprising emulsion and initiate coalescence of like phases and to result in the aqueous component-treated emulsion being sufficiently stable to pass through the degasser without passing through an emulsion inversion region while being sufficiently unstable to break down into hydrocarbon and aqueous constituents during separation downstream of the degasser.

2. The process of claim 1, wherein the hydrocarbon-comprising emulsion is derived from an in situ thermal process or crude oil operations comprising steam assisted gravity drainage (SAGD), expanding solvent-steam assisted gravity drainage (ES-SAGD), cyclic steam simulation (CSS), steam flooding (SF), solvent assisted-cyclic steam simulation, toe-to-heel-air-injection (THAI), or a solvent aided process (SAP).

3. The process of claim 1, wherein the hydrocarbon-comprising emulsion is a chemically complex heterogeneous tight emulsion comprising bitumen, and wherein the bitumen comprises asphaltenes.

4. The process of claim 3, wherein the chemically complex heterogeneous tight emulsion comprises a water-in-oil-in-water phase configuration comprising highly sheared droplets ranging in size from about 1 μm to about 100 μm.

5. The process of claim 1, wherein the water cut of the hydrocarbon-comprising emulsion is generally within the emulsion inversion region of the hydrocarbon-comprising emulsion, and wherein the increased water cut of the aqueous component-treated emulsion is such that a water-continuous phase is substantially the only phase in the aqueous component-treated emulsion.

6. The process of claim 1, wherein the aqueous component comprises fresh water, process derived water or a combination thereof.

7. The process of claim 1, wherein the contacting comprises adding the aqueous component to the hydrocarbon-comprising emulsion in pipe under a co-current flow, a counter-current flow, a co-current central flow, or a counter-current central flow.

8. The process of claim 1, wherein contacting upstream of the degasser is contacting generally in an immediate proximity to the degasser.

9. The process of claim 1, wherein dispersing comprises a use of a low shear mixer, and wherein separation downstream of the degasser comprises separation in a gravity separator.

10. The process of claim 1, wherein break down into hydrocarbon and aqueous constituents results in a generally distinct hydrocarbon phase and a generally distinct aqueous phase.

11. The process of claim 1 further comprising adding a processing aid to the aqueous component-treated emulsion.

12. A process for enhanced separation of a hydrocarbon-comprising emulsion, the process comprising:

contacting the hydrocarbon-comprising emulsion with an aqueous component upstream of a degasser;

dispersing the aqueous component within the hydrocarbon-comprising emulsion under low shear conditions so as to destabilize the hydrocarbon-comprising emulsion and initiate coalescence of like phases to form an aqueous component-treated emulsion;

degassing the aqueous component-treated emulsion in the degasser to form a degassed aqueous component-treated emulsion;

passing the degassed aqueous component-treated emulsion through a heat exchanger to produce a cooled degassed aqueous component-treated emulsion; and separating the cooled degassed aqueous component-treated emulsion in a gravity separator;

wherein the aqueous component-treated emulsion has an increased water cut and a reduced viscosity as compared to a water cut and a viscosity of the hydrocarbon-comprising emulsion, the aqueous component-treated emulsion being sufficiently stable to pass through the degasser without passing through an emulsion inversion region while being sufficiently unstable to break down into hydrocarbon and aqueous constituents during separation downstream of the degasser.

13. The process of claim 12 wherein separating the cooled degassed aqueous component-treated emulsion produces a reduced rag layer as compared to a rag layer produced from separating the hydrocarbon-comprising emulsion.

14. The process of claim 13 further comprising processing the reduced rag layer, a remaining aqueous component-treated emulsion, or both the reduced rag layer and the remaining aqueous component-treated emulsion in a treater.

15. A process for enhanced separation of a hydrocarbon-comprising emulsion, the process comprising:

contacting the hydrocarbon-comprising emulsion with an aqueous component to form an aqueous component-treated emulsion upstream of a heat exchanger; and dispersing a sufficient amount of the aqueous component within the hydrocarbon-comprising emulsion under low shear conditions to increase a water cut and reduce a viscosity of the aqueous component-treated emulsion as compared to a water cut and a viscosity of the hydrocarbon-comprising emulsion, to destabilize the hydrocarbon-comprising emulsion and initiate coalescence of like phases and to result in the aqueous component-treated emulsion being sufficiently stable to pass through the heat exchanger without passing through an emulsion inversion region while being sufficiently unstable to break down into hydrocarbon and aqueous constituents during separation downstream of the heat exchanger.

16. The process of claim 15, wherein the hydrocarbon-comprising emulsion is derived from an in situ thermal process or crude oil operations comprising steam assisted gravity drainage (SAGD), expanding solvent-steam assisted gravity drainage (ES-SAGD), cyclic steam simulation (CSS), steam flooding (SF), solvent assisted-cyclic steam simulation, toe-to-heel-air-injection (THAI), or a solvent aided process (SAP).

17. The process of claim 15, wherein the hydrocarbon-comprising emulsion is a chemically complex heterogeneous tight emulsion comprising bitumen, and wherein the bitumen comprises asphaltenes.

18. The process of claim 17, wherein the chemically complex heterogeneous tight emulsion comprises a water-in-oil-in-water phase configuration comprising highly sheared droplets ranging in size from about 1 nm to about 50 μm.

19. The process of claim 15, wherein the water cut of the hydrocarbon-comprising emulsion is generally within the emulsion inversion region of the hydrocarbon-comprising emulsion, and wherein the increased water cut of the aqueous component-treated emulsion is such that a water-continuous phase is substantially the only phase in the aqueous component-treated emulsion.

20. The process of claim 15, wherein the contacting comprises adding the aqueous component to the hydrocarbon-comprising emulsion in pipe under a co-current flow, a counter-current flow, a co-current central flow, or a counter-current central flow.

21. The process of claim 15, wherein contacting upstream of the heat exchanger is contacting generally in an immediate proximity to the heat exchanger, and wherein separation downstream of the heat exchanger comprises separation in a gravity separator.

22. A process for enhanced separation of a hydrocarbon-comprising emulsion, the process comprising:

contacting the hydrocarbon-comprising emulsion with an aqueous component upstream of a heat exchanger;

dispersing the aqueous component within the hydrocarbon-comprising emulsion under low shear conditions so as to destabilize the hydrocarbon-comprising emulsion and initiate coalescence of like phases to form an aqueous component-treated emulsion;

passing the aqueous component-treated emulsion to the heat exchanger to produce a cooled aqueous component-treated emulsion;

separating the cooled aqueous component-treated emulsion in a gravity separator to produce a reduced rag layer as compared to a rag layer produced from separating the hydrocarbon-comprising emulsion; and processing the reduced rag layer, a remaining aqueous component-treated emulsion, or both the reduced rag layer and the remaining aqueous component-treated emulsion in a treater;

wherein the aqueous component-treated emulsion has an increased water cut and a reduced viscosity as compared to a water cut and a viscosity of the hydrocarbon-comprising emulsion, the aqueous component-treated emulsion being sufficiently stable to pass through the heat exchanger without passing through an emulsion inversion region while being sufficiently unstable to break down into hydrocarbon and aqueous constituents during separation downstream of the heat exchanger.

23. A process for enhanced separation of a hydrocarbon-comprising emulsion, the process comprising:

contacting the hydrocarbon-comprising emulsion with an aqueous component to form an aqueous component-treated emulsion upstream of a separator; and dispersing a sufficient amount of the aqueous component within the hydrocarbon-comprising emulsion under low shear conditions to increase a water cut and reduce a viscosity of the aqueous component-treated emulsion as compared to a water cut and a viscosity of the hydrocarbon-comprising emulsion, to destabilize the hydrocarbon-comprising the aqueous component-treated emulsion being sufficiently stable to pass into the separator without passing through an emulsion inversion region while being sufficiently unstable to break down into hydrocarbon and aqueous constituents during separation in the separator.

24. The process of claim 23, wherein the hydrocarbon-comprising emulsion is derived from an in situ thermal process or crude oil operations comprising steam assisted gravity drainage (SAGD), expanding solvent-steam assisted gravity drainage (ES-SAGD), cyclic steam simulation (CSS), steam flooding (SF), solvent assisted-cyclic steam simulation, toe-to-heel-air-injection (THAI), or a solvent aided process (SAP).

25. The process of claim 23, wherein the hydrocarbon-comprising emulsion is a chemically complex heterogeneous tight emulsion comprising bitumen, and wherein the bitumen comprises asphaltenes.

26. The process of claim 25, wherein the chemically complex heterogeneous tight emulsion comprises a water-in-oil-in-water phase configuration comprising highly sheared droplets ranging in size from about 1 μm to about 50 μm.

27. The process of claim 26, wherein the water-in-oil-in-water phase configuration further comprises an entrained gas.

28. The process of claim 23, wherein the water cut of the hydrocarbon-comprising emulsion is generally within the emulsion inversion region of the hydrocarbon-comprising emulsion, and wherein the increased water cut of the aqueous component-treated emulsion is such that a water-continuous phase is substantially the only phase in the aqueous component-treated emulsion.

29. The process of claim 23, wherein the contacting comprises adding the aqueous component to the hydrocarbon-comprising emulsion in pipe under a co-current flow, a counter-current flow, a co-current central flow, or a counter-current central flow.

30. The process of claim 23, wherein contacting upstream of the separator is contacting generally in an immediate proximity to the separator, and wherein dispersing comprises a use of a low shear mixer.

31. The process of claim 23 further comprising adding a processing aid to the aqueous component-treated emulsion upstream of the separator, and separating the aqueous component-treated emulsion in the separator.

32. The process of claim 23, wherein break down into hydrocarbon and aqueous constituents results in a generally distinct hydrocarbon phase and a generally distinct aqueous phase.

33. A process for enhanced separation of a hydrocarbon-comprising emulsion, the process comprising:

contacting the hydrocarbon-comprising emulsion with an aqueous component to form an aqueous component-treated emulsion at a first selected location in a hydrocarbon processing circuit to control an occurrence of a high viscosity event in the hydrocarbon-comprising emulsion; and dispersing a sufficient amount of the aqueous component within the hydrocarbon-comprising emulsion under low shear conditions to increase a water cut and reduce a viscosity of the aqueous component-treated emulsion as compared to a water cut and a viscosity of the hydrocarbon-comprising emulsion, to destabilize the hydrocarbon-comprising emulsion and initiate coalescence of like phases and to result in the aqueous component-treated emulsion being sufficiently stable to pass through one or more processing units downstream of the first selected location without passing through the high viscosity event while being sufficiently unstable to break down into hydrocarbon and aqueous constituents at a second selected location in the hydrocarbon processing circuit downstream of the one or more processing units.

* * * * *

UNITED STATES PATENT AND TRADEMARK OFFICE

CERTIFICATE OF CORRECTION

PATENT NO. : 9,120,983 B2
APPLICATION NO. : 13/560920
DATED : September 1, 2015
INVENTOR(S) : Russell H. Wickes It is certified that error appears in the above-identified patent and that said Letters Patent is hereby corrected as shown below:

Claims

In column 30, line 15, Claim 18, Change "1 nm" to --1 μm--

Signed and Sealed this
First Day of March, 2016

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 9,120,983 B2
APPLICATION NO. : 13/560920
DATED : September 1, 2015
INVENTOR(S) : Russell H. Wickes It is certified that error appears in the above-identified patent and that said Letters Patent is hereby corrected as shown below:

Claims

In column 28, line 42, claim 2 Change "simulation" to -- stimulation --

In column 28, line 43, claim 2 Change "simulation" to -- stimulation --

In column 30, line 4, claim 16 Change "simulation" to -- stimulation --

In column 30, line 6, claim 16 Change "simulation" to -- stimulation --

In column 31, line 7, claim 23 Change "hydrocarbon-comprising the aqueous component-treated" to -- hydrocarbon-comprising emulsion and initiate coalescence of like phases, and to result in the aqueous component-treated --

In column 31, line 18, claim 24 Change "simulation" to -- stimulation --

In column 31, line 20, claim 24 Change "simulation" to -- stimulation --

Signed and Sealed this
Twenty-first Day of June, 2016

Michelle K. Lee

Michelle K. Lee
*Director of the United States Patent and Trademark Office*